US011247880B2

(12) United States Patent
Iwashita et al.

(10) Patent No.: US 11,247,880 B2
(45) Date of Patent: Feb. 15, 2022

(54) WINCH DRUM AND CRANE PROVIDED THEREWITH

(71) Applicant: KOBELCO CONSTRUCTION MACHINERY CO., LTD., Hiroshima (JP)

(72) Inventors: Hidekazu Iwashita, Hyogo (JP); Hideaki Fujiwara, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 22 days.

(21) Appl. No.: 16/962,446

(22) PCT Filed: Jan. 11, 2019

(86) PCT No.: PCT/JP2019/000672
§ 371 (c)(1),
(2) Date: Jul. 15, 2020

(87) PCT Pub. No.: WO2019/142731
PCT Pub. Date: Jul. 25, 2019

(65) Prior Publication Data

US 2021/0070590 A1 Mar. 11, 2021

(30) Foreign Application Priority Data

Jan. 16, 2018 (JP) ..... JP2018-004777

(51) Int. Cl.
*B66D 1/30* (2006.01)
*B66D 1/36* (2006.01)
*B66C 23/36* (2006.01)

(52) U.S. Cl.
CPC ..... *B66D 1/30* (2013.01); *B66C 23/36* (2013.01); *B66D 1/36* (2013.01); *B66D 2700/0191* (2013.01)

(58) Field of Classification Search
CPC ..... B65H 75/265; B65H 55/04; B66C 23/36; B66D 2700/0191; B66D 1/30; B66D 1/36
See application file for complete search history.

(56) References Cited

U.S. PATENT DOCUMENTS 1,408,463 A * 3/1922 Lewis ..... B66D 1/30 242/608.4
1,555,544 A * 9/1925 Anthony ..... B66D 1/34 242/587.1

(Continued)

FOREIGN PATENT DOCUMENTS

CN 202988626 U 6/2013
CN 103626064 A 3/2014

(Continued)

OTHER PUBLICATIONS

Extended European Search Report dated Apr. 29, 2021 in European Patent Application No. 19740817.2, 7 pages.

(Continued)

*Primary Examiner* — Michael E Gallion
(74) *Attorney, Agent, or Firm* — Oblon, McClelland, Maier & Neustadt, L.L.P.

(57) ABSTRACT

An inner face of a flange of a winch drum is provided with a rope guide part that guides a rope portion in a higher layer such that the rope portion in the higher layer crosses a rope portion in a lower layer in a first crossing section, and a ridge line of the rope guide part has a shape that is displaced in a winding rotation direction with respect to a baseline passing through a rotation axis and an inner edge of the ridge line as proceeding from the inner edge to an outer edge.

7 Claims, 23 Drawing Sheets

(56) References Cited

U.S. PATENT DOCUMENTS

| | | | | | |
|---|---|---|---|---|---|
| 1,984,604 | A * | 12/1934 | Stahl | B66D 1/36 | 254/278 |
| 2,330,086 | A * | 9/1943 | Shoffner | H02G 11/02 | 34/625 |
| 2,620,996 | A * | 12/1952 | Le Bus | B66D 1/36 | 242/602.2 |
| 2,708,080 | A * | 5/1955 | Le Bus, Sr. | B66D 1/36 | 242/602.2 |
| 2,732,150 | A * | 1/1956 | Le Bus | B66D 1/36 | 242/602.2 |
| 5,193,761 | A * | 3/1993 | Fritz | B65H 55/04 | 242/159 |
| 6,601,794 | B2 * | 8/2003 | Brutschin | B65H 75/265 | 242/602.1 |
| 8,702,067 | B2 * | 4/2014 | Meijer | B66D 1/36 | 254/385 |
| 2003/0006337 | A1 * | 1/2003 | Brutschin | B65H 75/265 | 242/613 |
| 2006/0208121 | A1 * | 9/2006 | Horiguchi | B65H 55/04 | 242/174 |
| 2009/0212147 | A1 | 8/2009 | Horiguchi et al. | | |
| 2014/0027691 | A1 * | 1/2014 | Ilaka | B66D 1/30 | 254/334 |

FOREIGN PATENT DOCUMENTS

| | | | |
|---|---|---|---|
| CN | 204211406 | U | 3/2015 |
| CN | 107200281 | A | 9/2017 |
| CN | 107200283 | A | 9/2017 |
| EP | 2 521 685 | B1 | 1/2016 |
| JP | 57-6474 | Y2 | 2/1982 |
| JP | 57-33030 | Y2 | 7/1982 |
| JP | 58-216892 | A | 12/1983 |
| JP | 6-23995 | U | 3/1994 |
| JP | 2006-282391 | A | 10/2006 |
| JP | 2015-209283 | A | 11/2015 |

OTHER PUBLICATIONS

International Search Report dated Apr. 16, 2019 in PCT/JP2019/000672 filed on Jan. 11, 2019, 1 page.

* cited by examiner

WINCH DRUM AND CRANE PROVIDED THEREWITH

TECHNICAL FIELD

The present invention relates to a winch drum for winding a rope used in a crane or the like.

BACKGROUND ART

In the related art, the winch drum disclosed in Patent Literature 1 for example is known as a winch drum for winding a rope used in a crane or the like.

The winch drum described in Patent Literature 1 is provided with a winding drum around which a rope is wound in a plurality of layers, and a pair of flanges provided on either end of the winding drum in the width direction. In the winch drum, a rope groove is provided on the outer circumferential surface of the winding drum. Also, on the inner face of each flange, a rope guide part referred to as a rope kick is provided protruding inward. In such a winch drum, first, the rope of the first layer is wound neatly by slipping into the rope groove. Additionally, the rope of the second and higher layers is successively wound on top of the rope of the lower layer.

Meanwhile, when hoisting a load with the rope, the diameter of the rope becomes smaller compared to when a load is not being hoisted. Additionally, the diameter of the rope may also decrease due to factors such as ordinary wear and tear over time. If the diameter of the rope becomes smaller compared to the ideal dimensions in this way, problems like the following occur.

In other words, if the diameter of the rope becomes smaller compared to the ideal dimensions, the gap between the last row of the rope and the inner face of the flange becomes larger in the second layer for example. For this reason, the first row of the rope in the third layer cannot be positioned directly above the rope in the lower layer (second layer) when positioned opposite a ridge line of the rope guide part, and instead exists at a position shifted toward the inner face of the flange. In this way, in the case where the first row of the rope in the third layer is in a position shifted toward the inner face of the flange with respect to the last row of the rope in the second layer, the first row of rope in the third layer cannot cross over the rope in the last row of the second layer at the position where the rope guide part is provided. Consequently, the first row of rope in the third layer cannot move to the proper position, that is, the position crossing over the last row of the second layer. As a result, in the third layer, a large gap may be formed between the first row of rope and the second row of rope.

If the rope continues to be wound in the state in which such a gap has formed, the rope in a higher layer may fall into a gap like the one described above, and the winding of the rope may become irregular.

CITATION LIST

Patent Literature

Patent Literature 1: Japanese Unexamined Utility Model (Registration) Application Publication No. H6-023995

SUMMARY OF INVENTION

The present invention has been devised in light of the above problem, and an object thereof is to provide a winch drum capable of winding a rope neatly even in the case where the diameter of the rope is smaller than the ideal dimensions, as well as a crane provided with such a winch drum.

The present invention relates to a winch drum rotatable about a rotation axis in a winding rotation direction in which a rope is wound and an opposite direction of the winding rotation direction. The winch drum includes a winding drum around which the rope is wound such that a plurality of rope portions forming the rope are arranged in a width direction of the winding drum and are also layered in a plurality of layers in a radial direction of the winding drum, and a pair of flanges provided on either end of the winding drum in the width direction. On an outer circumferential surface of the winding drum, a first parallel section having a plurality of parallel grooves parallel to a circumferential direction of the outer circumferential surface and lined up in the width direction, a first crossing section having a plurality of inclined grooves inclined with respect to the circumferential direction and lined up in the width direction, a second parallel section having a plurality of parallel grooves parallel to the circumferential direction and lined up in the width direction, and a second crossing section having a plurality of inclined grooves inclined with respect to the circumferential direction and lined up in the width direction are formed in the above order in the circumferential direction. An inner face of each of the pair of flanges is provided with a rope guide part that guides a rope portion in a higher layer such that the rope portion in the higher layer crosses a rope portion in a lower layer in the first crossing section. The rope guide part has a first inclined face that the rope opposes when the rope is wound, a second inclined face that the rope opposes when the rope is wound, the second inclined face being adjacent to the first inclined face in the opposite direction of the winding rotation direction, and a ridge line positioned at a boundary between the first inclined face and the second inclined face to form an inner side of each. The first inclined face has an outer side at a position shifted in the winding rotation direction with respect to the ridge line, and has a shape that is inclined with respect to the inner face to be positioned farther inward in the width direction of the winding drum as proceeding from the outer side of the first inclined face to the ridge line. The second inclined face has an outer side at a position shifted in the opposite direction of the winding rotation direction with respect to the ridge line, and has a shape that is inclined with respect to the inner face to be positioned farther inward in the width direction of the winding drum as proceeding from the outer side of the second inclined face to the ridge line. The ridge line has an inner edge positioned on the winding drum side and an outer edge positioned closer to an outer circumference of the flange than the inner edge. The ridge line has a shape displaced in the opposite direction of the winding rotation direction with respect to a baseline as proceeding from the inner edge to the outer edge, the baseline being a straight line passing through the rotation axis and the inner edge.

DESCRIPTION OF EMBODIMENTS

Hereinafter, embodiments of the present invention will be described in detail on the basis of the drawings.

[Crane]

Figure 1:
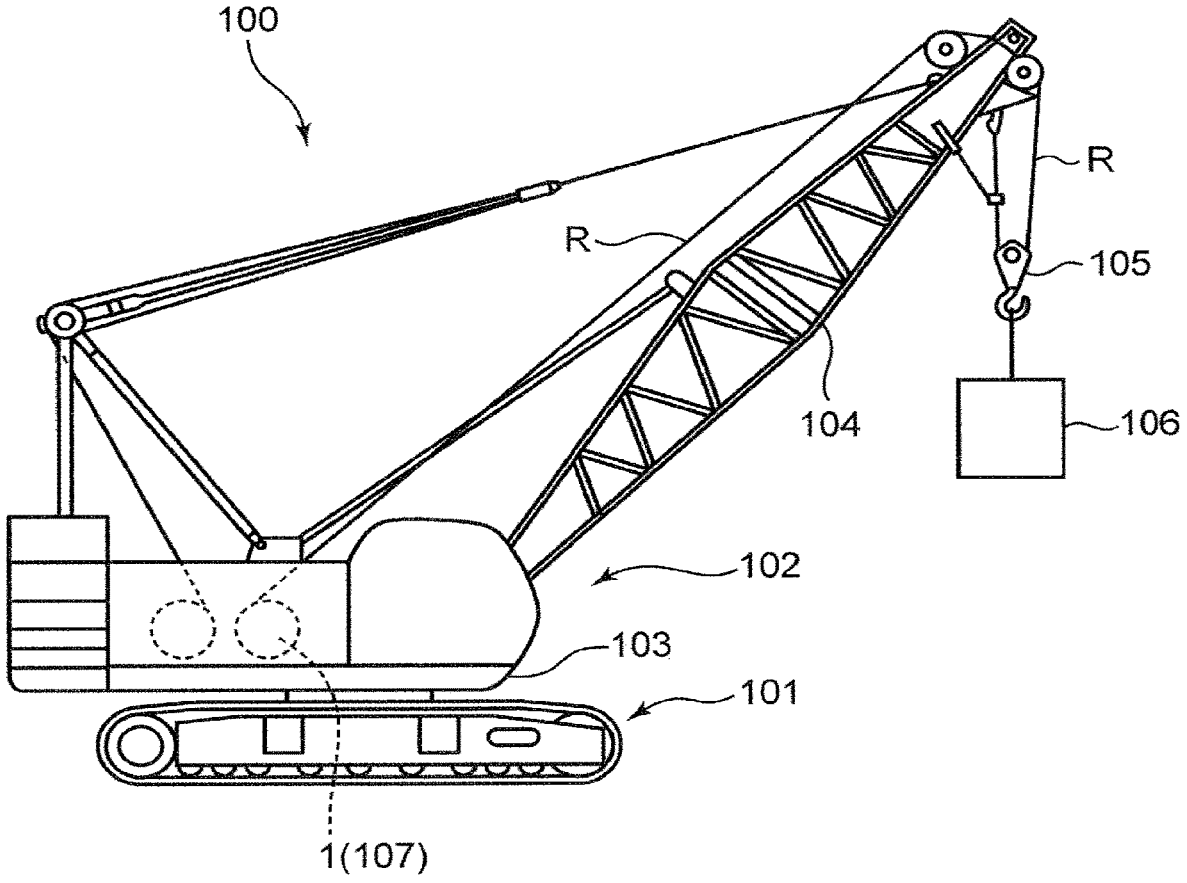
FIG. 1 is a side view illustrating a crane according to an embodiment of the present invention.

FIG. 1 is a side view illustrating a diagram of a crane 100 according to an embodiment of the present invention. As illustrated in FIG. 1, a crane 100 includes an automotive lower travelling body 101 and an upper stewing body 102 disposed on the lower travelling body 101.

The upper stewing body 102 includes a stewing frame 103 capable of stewing about a vertical axis on the lower travelling body 101, a boom 104 attached to a front part of the stewing frame 103 to allow the boom 104 to be raised and lowered, a hook 105 suspended from the front end of the boom 104 through a rope R (wire rope), and a winch device 107.

The winch device 107 is a device that causes the hook 105 to perform raising and lowering motions for hoisting work by winding or feeding the rope R joined to the hook 105. The winch device 107 includes a winch drum 1, and a driving source not illustrated such as a hydraulic motor and a speed reducer. The winch device 107 is placed, for example, behind the part where the boom 104 is attached to the stewing frame 103.

Figure 2:
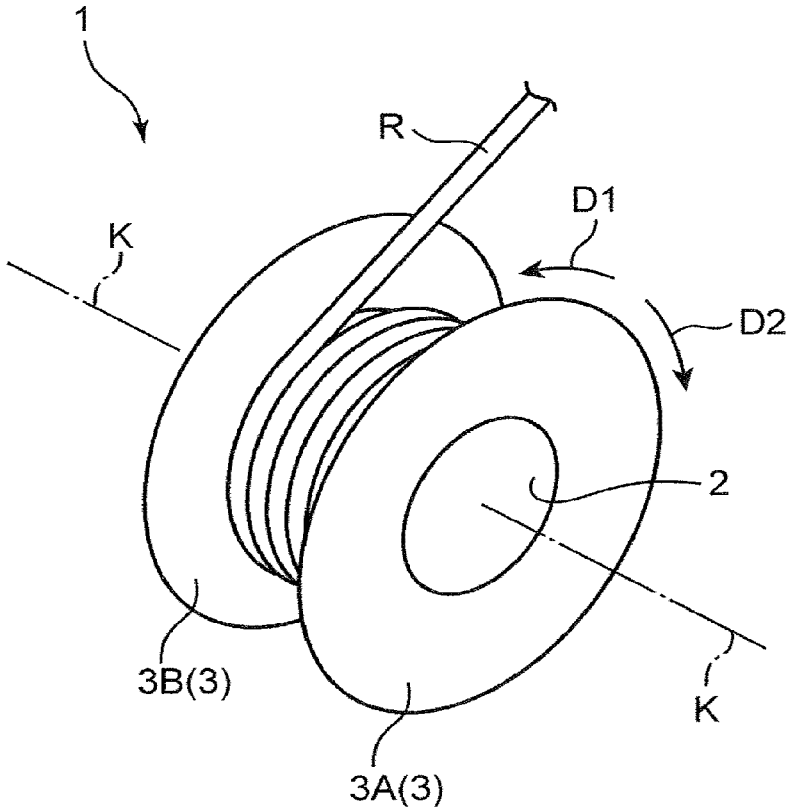
FIG. 2 is a perspective view illustrating a winch drum according to an embodiment of the present invention.

FIG. 2 is a perspective view illustrating the winch drum 1 according to an embodiment of the present invention. As illustrated in FIG. 2, the winch drum 1 includes a winding drum 2 around which the rope R is wound in a plurality of layers, and a pair of flanges 3 (first flange 3A and second flange 3B) provided on either end of the winding drum 2 in a width direction W (the direction parallel to the axial direction of a rotation axis K illustrated in FIG. 3). The winch drum 1 rotates about the rotation axis K by the driving source to wind or feed the rope R. The winch drum 1 is supported by the slewing frame 103 such that the machine width direction of the crane 100 and the rotation axis K are aligned.

The rope R is drawn out from the winding drum 2, passes the front end of the boom 104, and hangs down from the front end of the boom 104 with the hook 105 suspended thereon. By rotating in a winding rotation direction D1 that is one of the rotation directions about the rotation axis K, the winch drum 1 winds the rope R around the winding drum 2, thereby raising the hook 105. Also, by rotating in an opposite direction D2 (feeding rotation direction D2) that is the opposite of the winding rotation direction D1, the winch drum 1 feeds the rope R, thereby lowering the hook 105.

[Winch Drum]

Hereinafter, the winch drum 1 according to the first to fourth embodiments of the present invention will be described in detail, but first, a winch drum according to a comparative example and associated problems will be described.

Figure 15:
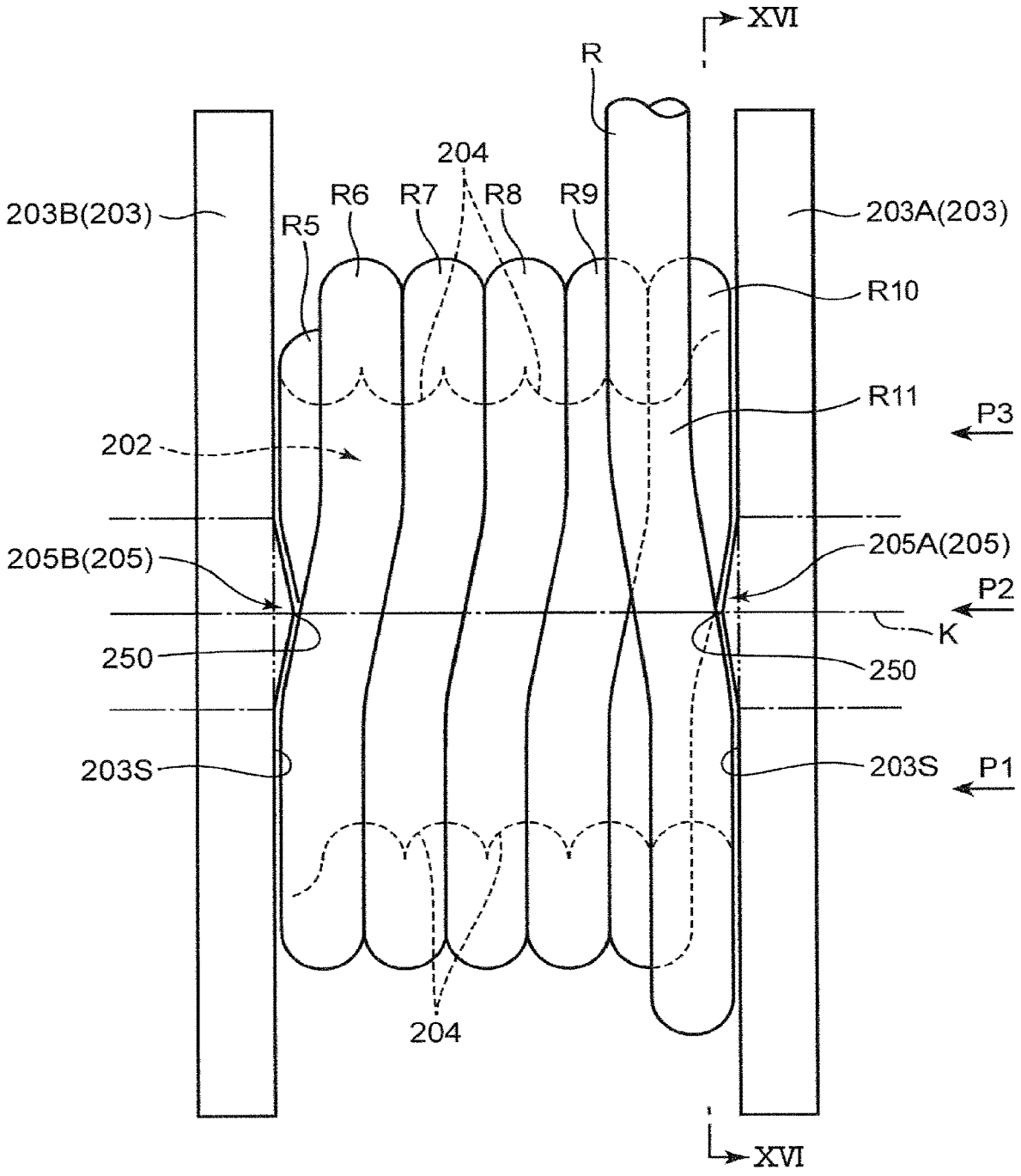
FIG. 15 is a plan view illustrating a winch drum according to a comparative example.

As illustrated in FIG. 15, a winch drum according to a comparative example includes a winding drum 202 around which a rope R is wound in a plurality of layers, and a pair of flanges 203 (first flange 203A and second flange 203B) provided on either end of the winding drum 202 in the width direction. In the winch drum, a rope groove 204 is provided on the outer circumferential surface of the winding drum 202.

Figure 16:
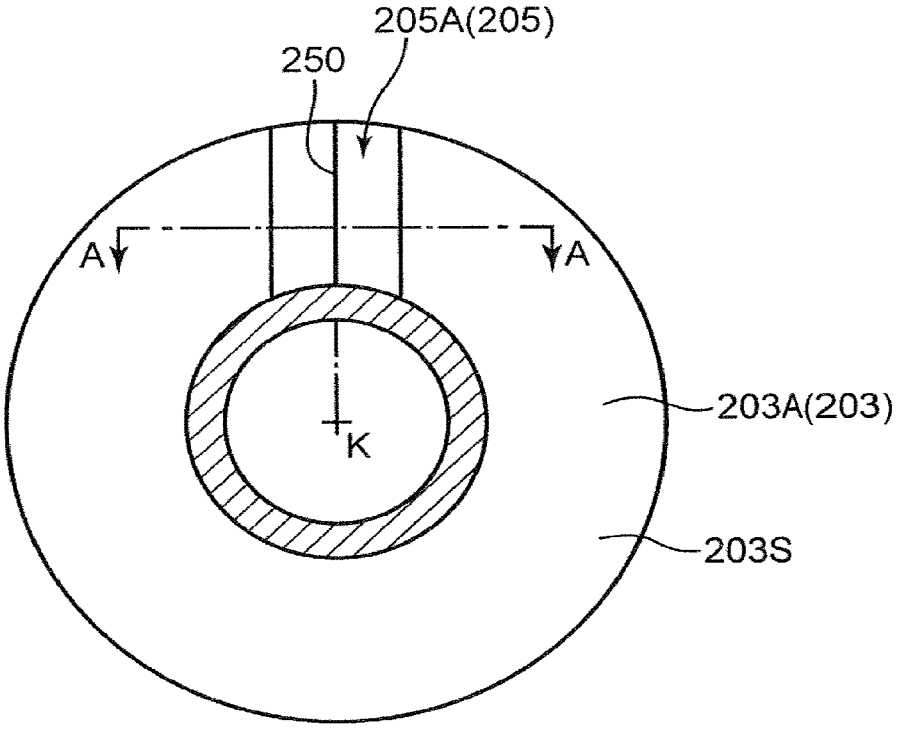
FIG. 16 is a cross section taken along the line XVI-XVI in FIG. 15.
Figure 17:
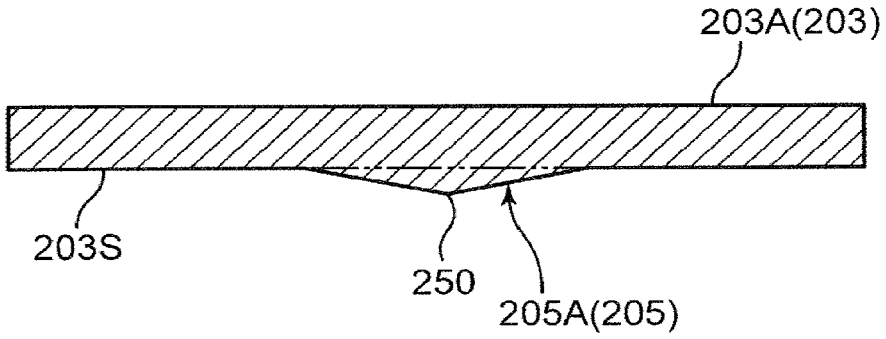
FIG. 17 is a cross section illustrating the flange when viewed in the direction of the arrow at the position of the line A-A in FIG. 16.
Figure 18:
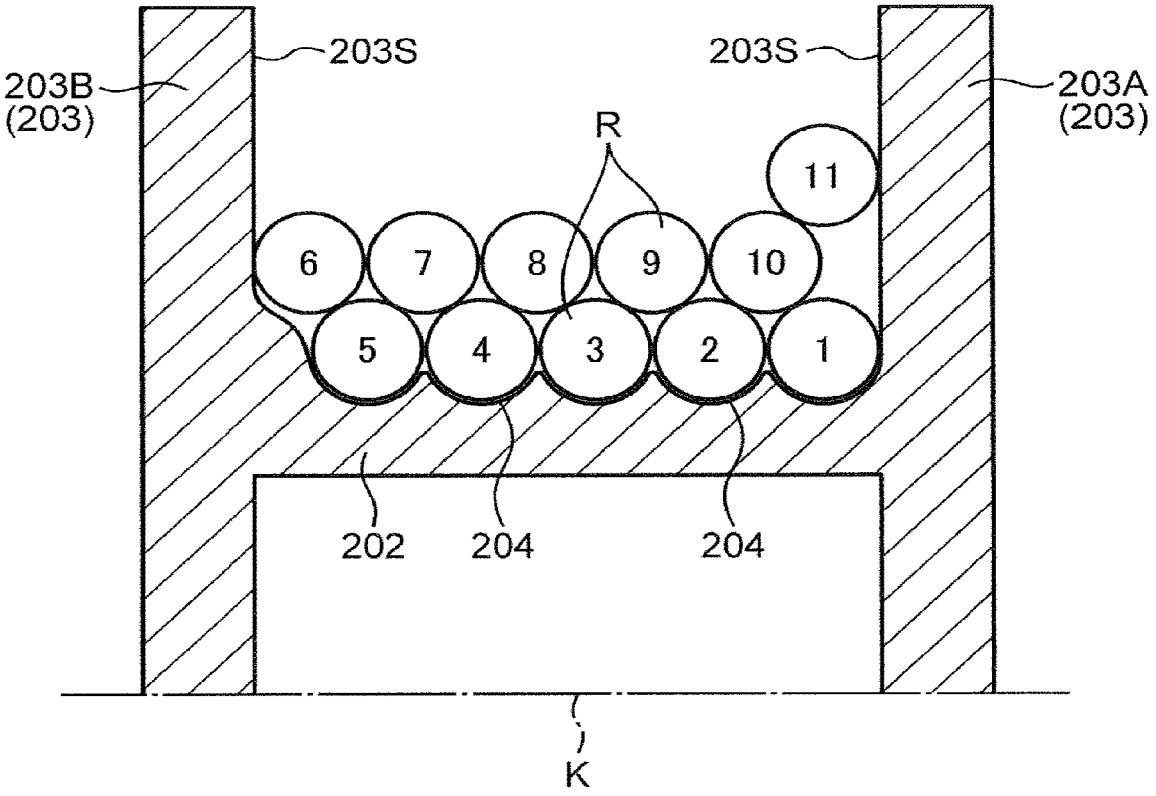
FIG. 18 is a diagrammatic view illustrating how the rope is arranged at the position P1 in FIG. 15.

Also, as illustrated in FIGS. 15, 16, and 17, on an inner face 203S of each flange 203, a rope guide part 205 referred to as a rope kick is provided protruding inward. FIG. 18 is a diagrammatic view illustrating how the rope is arranged at the position P1 in FIG. 15, FIG. 19 is a diagrammatic view illustrating how the rope is arranged at the position P2 in FIG. 15, and FIG. 20 is a diagrammatic view illustrating how the rope is arranged at the position P3 in FIG. 15.

Figure 19:
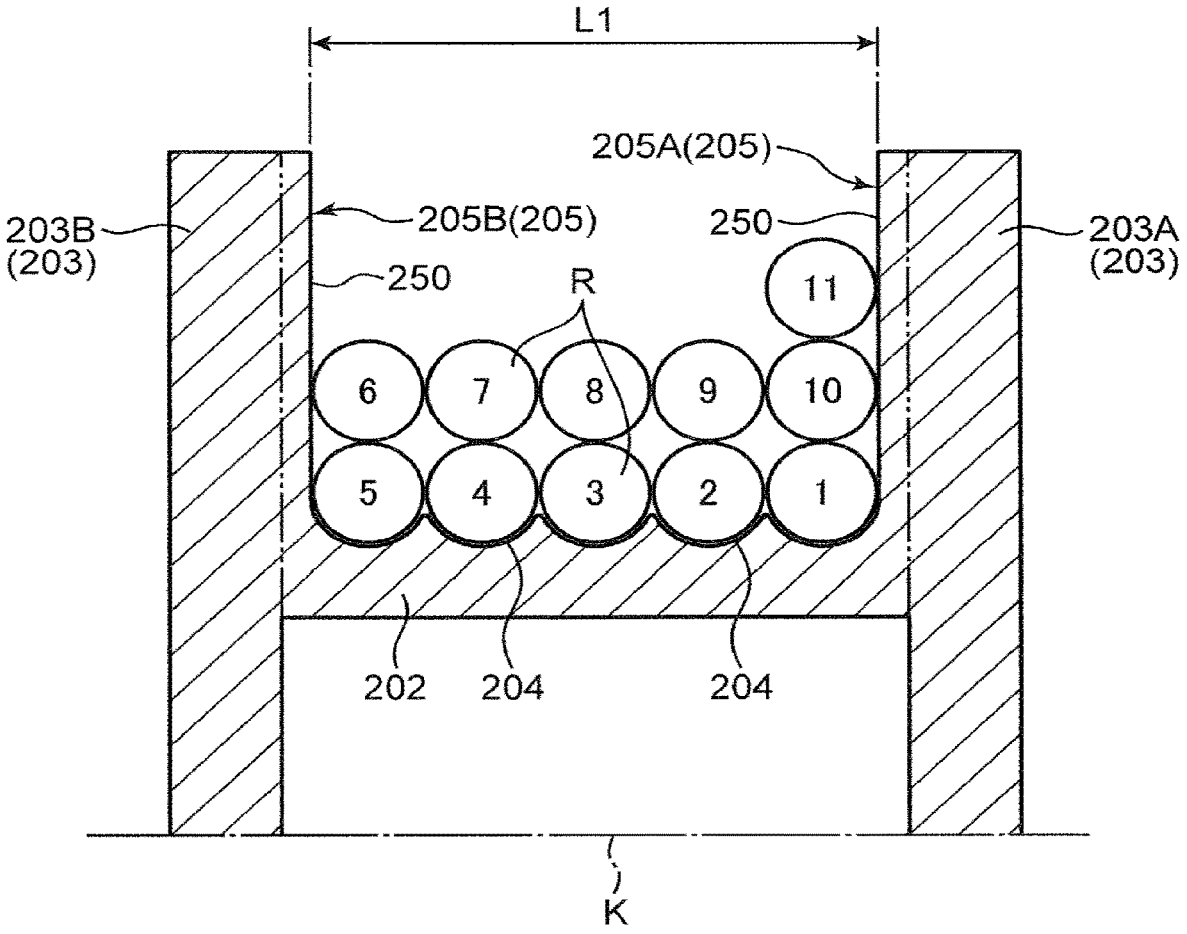
FIG. 19 is a diagrammatic view illustrating how the rope is arranged at the position P2 in FIG. 15.
Figure 20:
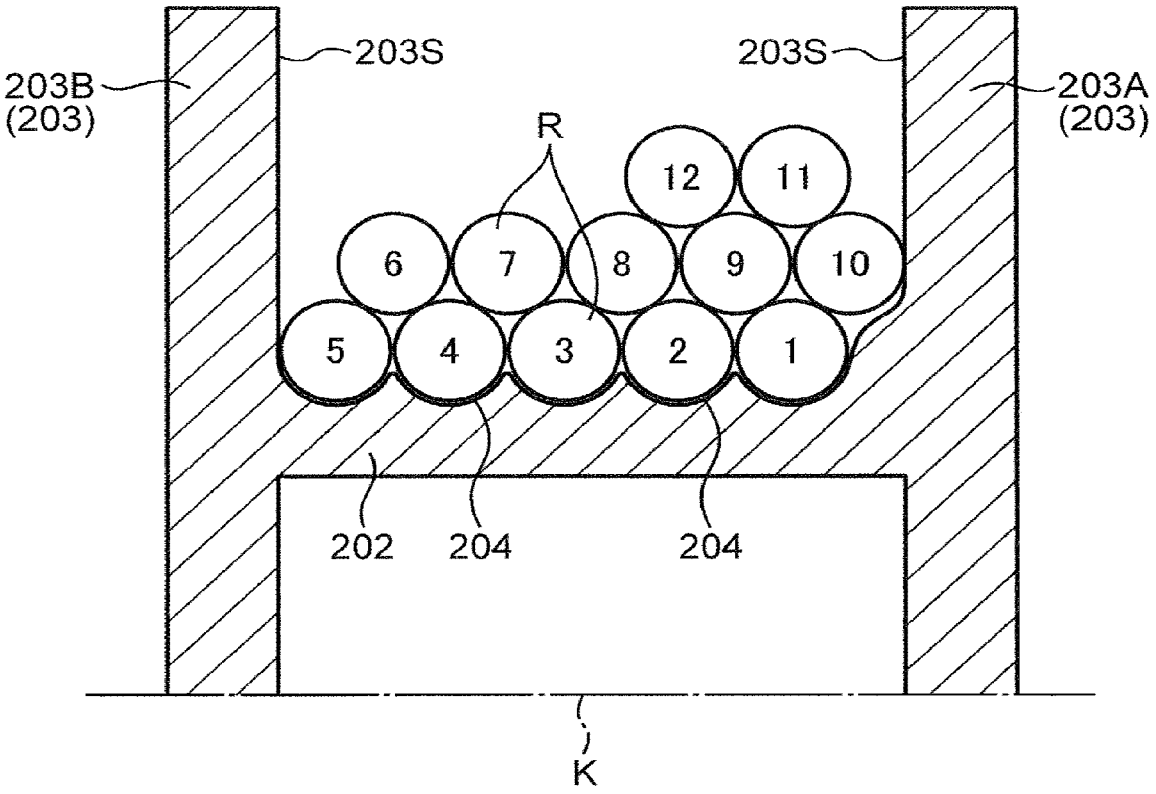
FIG. 20 is a diagrammatic view illustrating how the rope is arranged at the position P3 in FIG. 15.

In FIG. 19, L1 is the inner face-to-face dimension (guide-to-guide dimension) between the first flange 203A and the second flange 203B, and indicates the guide-to-guide dimension in the portion where a ridge line 250 of a first rope guide part 205A and a ridge line 250 of a second rope guide part 205B exist. The guide-to-guide dimension L1 is set to a dimension determined by multiplying the number of rows of the rope portion in each layer by the rope diameter. Consequently, in the portion where the ridge lines 250 of the rope guide parts 205 exist, the rope R is in a state in which the rope portions in higher and lower layers overlap each other vertically, as illustrated in FIG. 19. On the other hand, as illustrated in FIGS. 18 and 20, in the portions other than the rope guide parts 205, the rope R is in a state in which the higher-layer rope portion is positioned in the valley between two adjacent lower-layer rope portions.

In such a winch drum, first, of the rope R, rope portions R1 to R5 in a first layer are neatly wound by slipping into the rope groove 204. Thereafter, a rope portion R6 in the first row of a second layer moves from a position closer to the flange 203B than the rope portion R5 in the first layer as illustrated in FIG. 18 and is guided by the rope guide part 205B to move directly above the rope portion R5 as illustrated in FIG. 19, and is furthermore guided by the rope guide part 205B to move directly above the valley formed by the rope portion R4 and the rope portion R5 in the first layer as illustrated in FIG. 20. With this arrangement, rope portions R6 to R10 in the second layer are neatly wound. Thereafter, a rope portion R11 in the first row of a third layer is guided by the rope guide part 205A similarly to the case of the rope portion R6, and moves from the position illustrated in FIG. 18 to the position illustrated in FIG. 20, or in other words, to directly above the valley faulted by the rope portion R9 and the rope portion R10 in the second layer.

In the specification and the drawings, each of the rope portions R1 to R12 forms part of the single continuous rope R. Also, in the drawings, as illustrated in FIG. 18 for example, the numeral "1" is written inside the circle representing the rope portion R1 positioned in the first row of the first layer, and the numeral "2" is written inside the circle representing the rope portion R2 positioned in the adjacent second row. Also, as illustrated in FIG. 18 for example, the first layer contains the rope portion R1 positioned in the first row to the rope portion R5 positioned in the last row (in FIG. 18, the fifth row) of the first layer. The second layer contains the rope portion R6 positioned in the first row to the rope portion R10 positioned in the last row (in FIG. 18, the fifth row) of the second layer. Similarly, each of the third and higher layers contains the rope portion positioned in the first row to the rope portion positioned in the last row of the layer. The same applies to FIGS. 3, 7, and 8 described later.

Meanwhile, when hoisting a load with the rope R, the diameter of the rope R becomes smaller compared to when a load is not being hoisted. Additionally, the diameter of the rope R may also decrease due to factors such as ordinary wear and tear over time. Furthermore, in some cases, the dimension obtained by multiplying the diameter of the rope R by the number of rows of rope is relatively smaller than the guide-to-guide dimension L1 because of factors such as the dimensional tolerance of the winch drum and the dimensional tolerance of the rope. If the diameter of the rope R becomes smaller compared to the ideal dimensions in this way, problems like the following occur.

Figure 21:
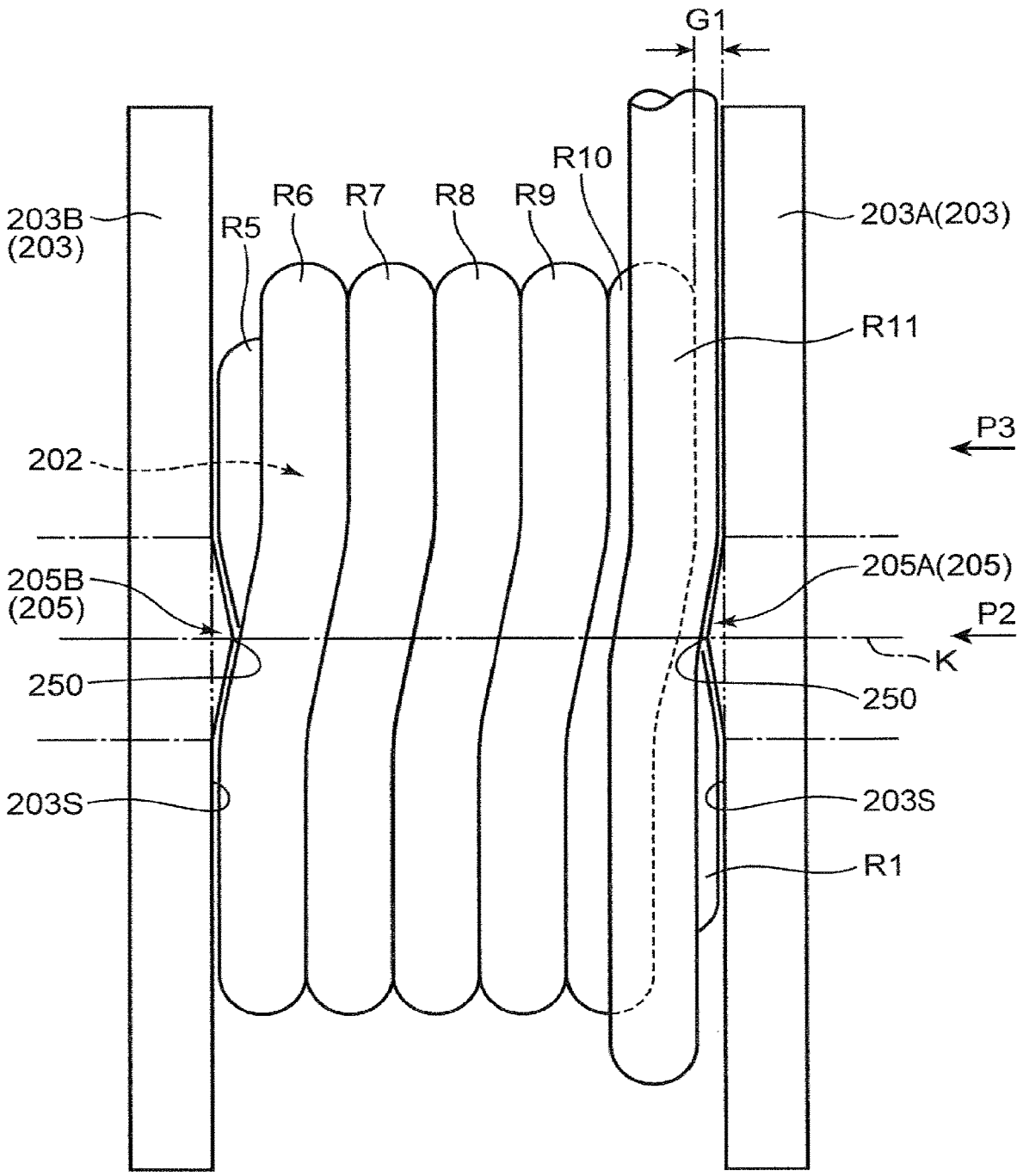
FIG. 21 is a plan view illustrating a winch drum according to a comparative embodiment, and is a diagram illustrating a state in which a gap has formed between the rope and the flange because of a decrease in the diameter of the rope.
Figure 22:
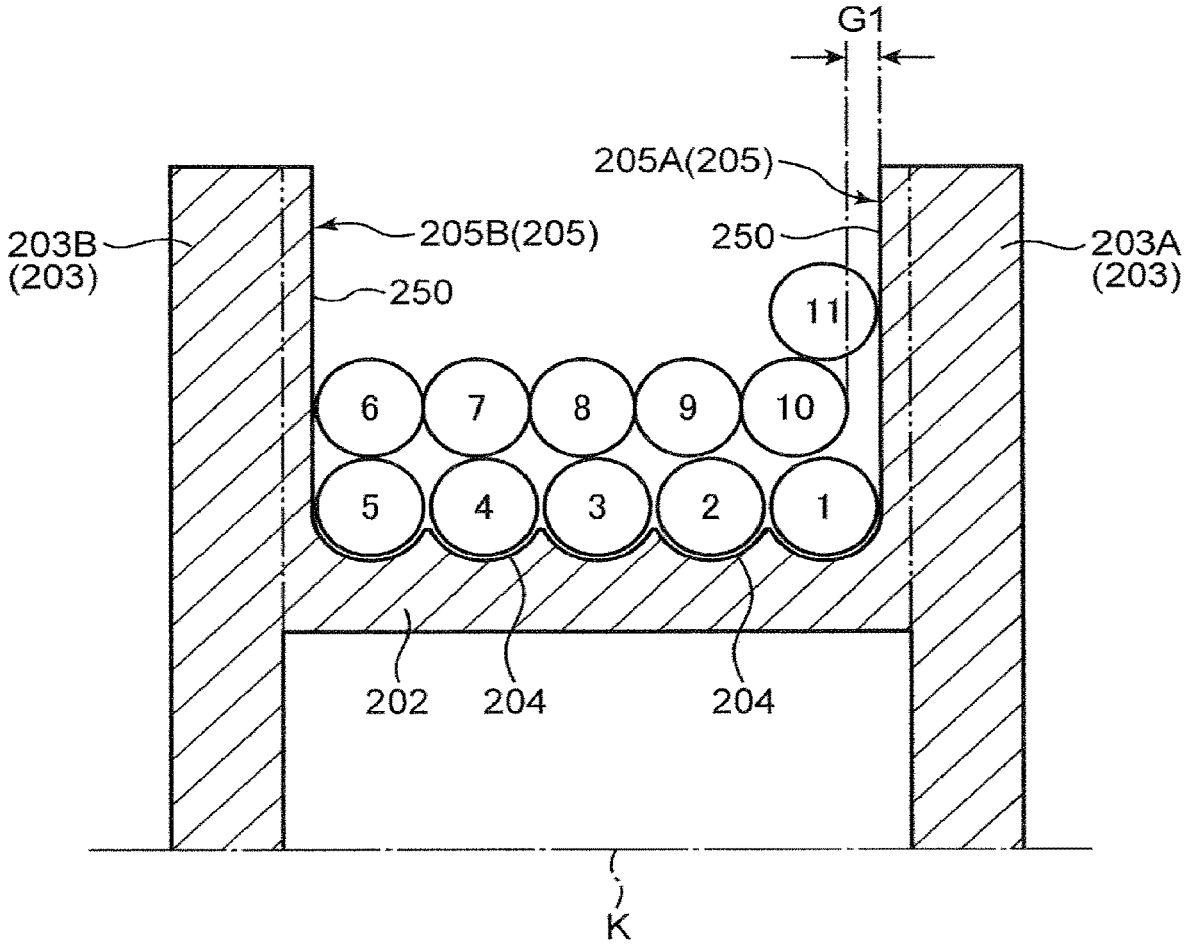
FIG. 22 is a diagrammatic view illustrating how the rope is arranged at the position P2 in FIG. 21.
Figure 23:
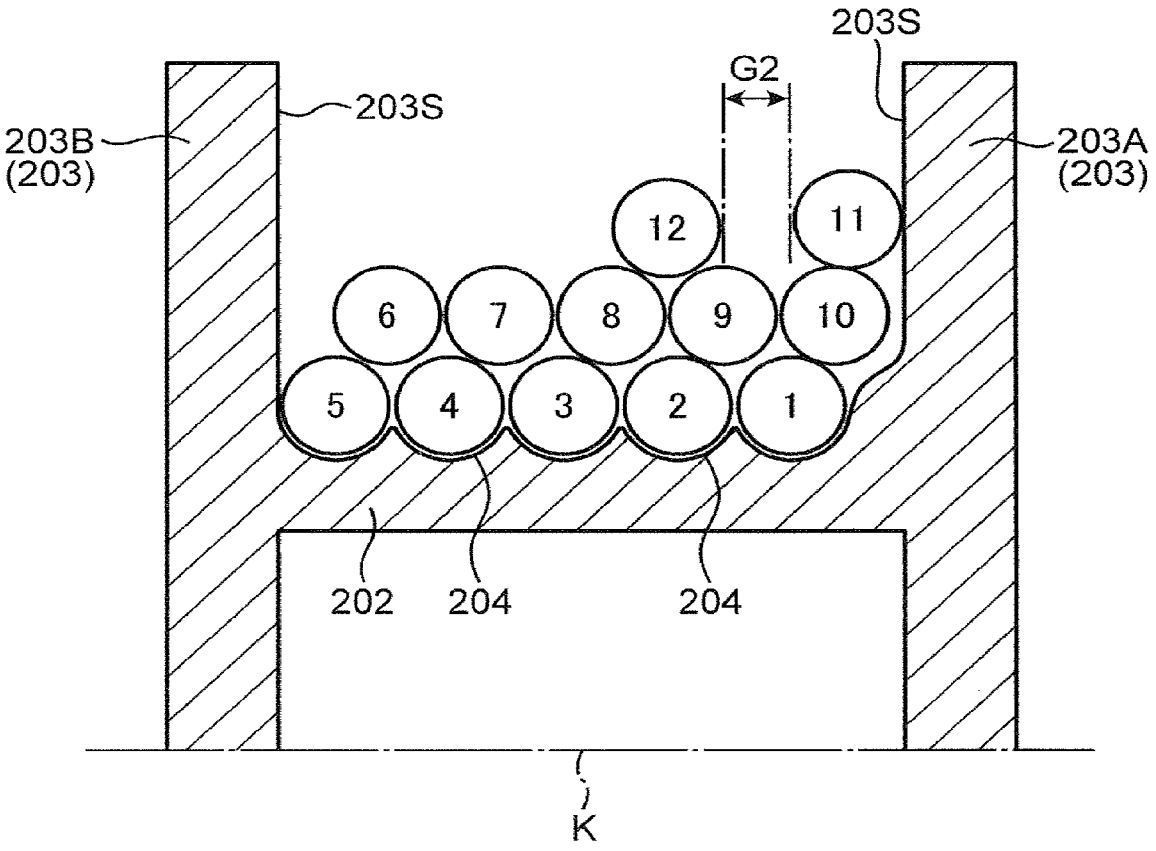
FIG. 23 is a diagrammatic view illustrating how the rope is arranged at the position P3 in FIG. 21.

In other words, if the diameter of the rope R becomes smaller compared to the ideal dimensions, as illustrated in FIGS. 21 and 22, the rope portions R6 to R10 in the second layer for example become positioned closer to the flange 203B compared to the ideal state illustrated in FIG. 15. As a result, a gap G1 between the rope portion R10 in the last row (fifth row) of the second layer and the flange 203A increases. For this reason, when the rope portion R11 in the first row of the third layer is positioned opposite the ridge line 250 of the rope guide part 205 as illustrated in FIGS. 21 and 22, the rope portion R11 cannot be positioned directly above the rope portion R10 in the lower layer (second layer), and instead exists at a position shifted toward the flange 203A. As illustrated in FIG. 22, in the case where the rope portion R11 is at a position shifted toward the flange 203A with respect to the rope portion R10, the guiding effect of the rope guide part 205A is not adequately obtained, and the rope portion R11 in the third layer cannot cross over the rope portion R10 in the second layer inwardly in the width direction. Consequently, the rope portion R11 in the third layer cannot move to the proper position (the position illustrated in FIG. 20), or in other words, the position directly above the valley formed by the rope portion R9 and the rope portion R10 in the second layer. As a result, as illustrated in FIG. 23, in the third layer, a large gap G2 may be formed between the rope portion R11 in the first row and the rope portion R12 in the second row.

If the rope R continues to be wound in the state in which such a gap G2 has formed, the rope portion R in a higher layer may fall into the gap G2 described above, and the winding of the rope may become irregular. Also, when the rope portion R11 in the first row of the third layer moves from the position illustrated in FIG. 21 to a position like the one illustrated in FIG. 15, an extremely loud noise may be produced. Specifically, an extremely loud noise may be produced when a force imparted to the rope portion R11 in the first row of the third layer causes the rope portion R11 to move from the position not directly above the rope portion R10 in the last row of the second layer but shifted toward the flange 203A (the position illustrated in FIG. 21) to the position crossing over the rope portion R10 in the last row toward the rope portion R9 of the second layer (the position illustrated in FIG. 15, or in other words, the position of the valley formed by the rope portion R9 and the rope portion R10).

FIRST EMBODIMENT

Figure 3:
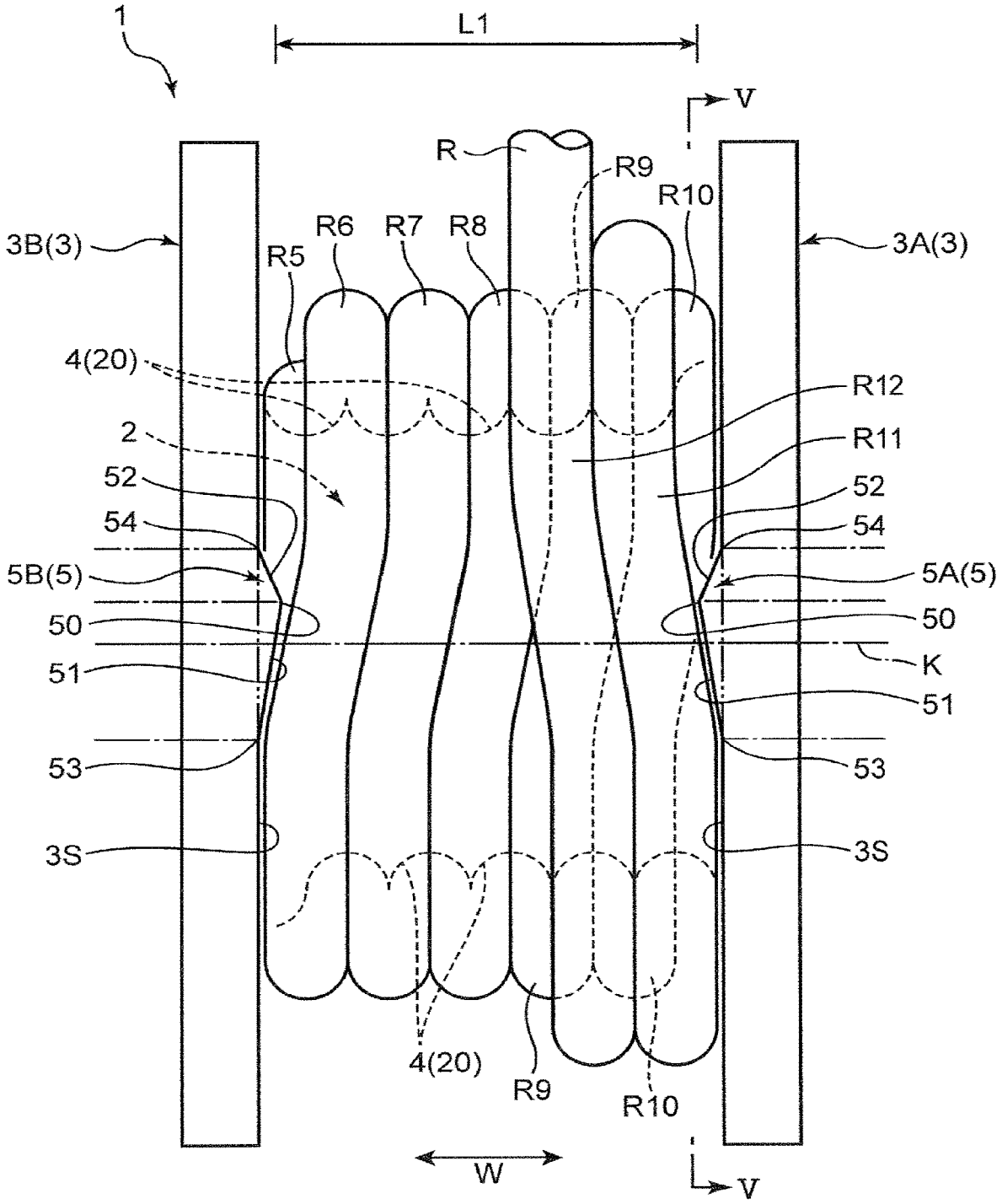
FIG. 3 is a plan view illustrating a winch drum according to a first embodiment of the present invention.
Figure 4:
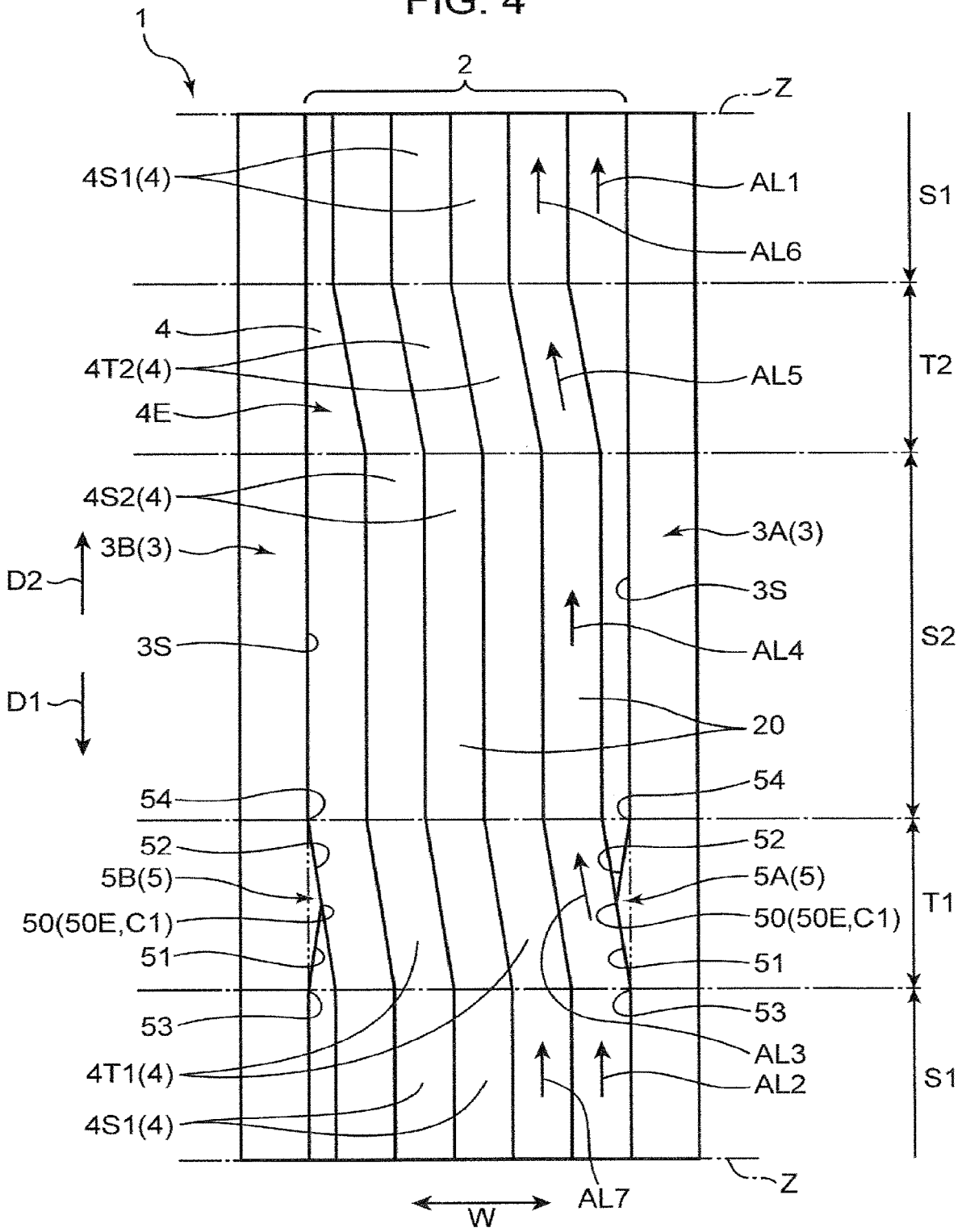
FIG. 4 is a development view of a winch drum for explaining the arrangement of rope grooves provided on the outer circumferential surface of a winding drum of the winch drum according to the first embodiment.

FIG. 3 is a plan view illustrating the winch drum 1 according to a first embodiment of the present invention. FIG. 4 is a development view of the winch drum 1 for explaining the arrangement of a rope groove 4 of the winch drum 1 according to the first embodiment. The winch drum 1 according to the present embodiment is what is referred to as a lebus type winch drum. The winding drum 2 is the member around which the rope R is wound, and in the winding drum 2, the plurality of rope portions forming the rope R are arranged in the width direction W of the winding drum 2 and also stacked in a plurality of layers in the radial direction of the winding drum 2. As illustrated in FIGS. 3 and 4, in the winch drum 1, a rope groove 4 is provided on an outer circumferential surface 20 of the winding drum 2. Of the rope R, the rope portions R1 to R5 in the first layer are neatly wound by slipping into the rope groove 4.

As illustrated in FIG. 4, the rope groove 4 includes a plurality of first parallel grooves 4S1 provided in a first parallel section S1 and lined up in the width direction W, a plurality of first inclined grooves 4T1 provided in a first crossing section T1 and lined up in the width direction W, a plurality of second parallel grooves 4S2 provided in a second parallel section S2 and lined up in the width direction W, and a plurality of second inclined grooves 4T2 provided in a second crossing section T2 and lined up in the width direction W. The first parallel section S1, the first crossing section T1, the second parallel section S2, and the second crossing section T2 are lined up the above order in the circumferential direction on the outer circumferential surface 20 of the winding drum 2.

The plurality of first parallel grooves 4S1 in the first parallel section S1 and the plurality of second parallel grooves 4S2 in the second parallel section S2 are grooves parallel to the circumferential direction of the outer circumferential surface 20 of the winding drum 2. The plurality of first inclined grooves 4T1 in the first crossing section T1 and the plurality of second inclined grooves 4T2 in the second crossing section T2 are grooves inclined with respect to the circumferential direction of the outer circumferential surface 20 of the winding drum 2. The plurality of inclined grooves 4T1 and 4T2 in the crossing sections T1 and T2 are inclined in the same direction.

Specifically, in the development view of FIG. 4, the region indicated by the chain line Z at the upper edge and the region indicating by the chain line Z at the lower edge are joined to each other in the actual winding drum 2 of the winch drum 1, and are the same position on the outer circumferential surface 20 of the winding drum 2. The first parallel groove 4S1 indicated by the arrow AL1 in the upper right of FIG. 4 is a parallel groove positioned in the first row of the first parallel section S1, and the first parallel groove 4S1 indicated by the arrow AL2 in the lower right of FIG. 4 is similarly a parallel groove positioned in the first row of the first parallel section S1. Also, the first parallel groove 4S1 indicated by the arrow AL6 in the upper right of FIG. 4 is a parallel groove positioned in the second row of the first parallel section S1, and the first parallel groove 4S1 indicated by the arrow AL7 in the lower right of FIG. 4 is similarly a parallel groove positioned in the second row of the first parallel section S1.

The plurality of first parallel grooves 4S1 illustrated in the lower part of the development view of FIG. 4 are respectively connected to the plurality of first inclined grooves 4T1 illustrated above in the diagram. The plurality of first inclined grooves 4T1 are respectively connected to the plurality of second parallel grooves 4S2 illustrated above in the diagram. The plurality of second parallel grooves 4S2 are respectively connected to the plurality of second inclined grooves 4T2 illustrated above in the diagram. The second inclined grooves 4T2 are respectively connected to the plurality of first parallel grooves 4S1 illustrated above in the diagram. In this way, by joining adjacent grooves to each other in the circumferential direction, the plurality of first parallel grooves 4S1, the plurality of first inclined grooves 4T1, the plurality of second parallel grooves 4S2, and the plurality of second inclined grooves 4T2 feint a single continuous rope groove 4.

In the case where the winding start position of the rope R is set to the first parallel groove 4S1 indicated by the arrow AL1 in the upper right for example, the rope R enters the first parallel groove 4S1 and is wound along the arrow AL1, and upon reaching the position indicated by the chain line Z at the upper edge of FIG. 4, enters the first parallel groove 4S1 indicated by the arrow AL2 in the lower right and is wound along the arrow AL2. After that, the rope R is further wound by entering the grooves in the order of the first inclined groove 4T1 in the first crossing section T1 indicated by the arrow AL3, the second parallel groove 4S2 in the second parallel section 52 indicated by the arrow AL4, the second inclined groove 4T2 in the second crossing section T2 indicated by the arrow AL5, and the first parallel groove 4S1 in the first parallel section S1 indicated by the arrows AL6 and AL7. Thereafter, the rope R similarly enters the single continuous rope groove 4 and is wound.

More specifically, when the rope R is wound around the winding drum 2, the plurality of first inclined grooves 4T1 in the first crossing section T1 function as follows. Namely, by having each the rope portions R1 to R5 in the first layer slip into the corresponding first inclined grooves 4T1, the position of each of the rope portions R1 to R5 is moved toward the flange 3B by ½ pitch (approximately the radius of the rope R). Similarly, when the rope R is wound around the winding drum 2, the plurality of second inclined grooves 4T2 in the second crossing section T2 function as follows. Namely, by having each the rope portions R1 to R5 in the first layer slip into the corresponding second inclined grooves 4T2, the position of each of the rope portions R1 to R5 is moved toward the flange 3B by ½ pitch (approximately the radius of the rope R). Consequently, by having the rope R complete a full revolution around the winding drum 2, the position of the rope R moves toward the flange 3B by 1 pitch (approximately the diameter of the rope R).

Also, as illustrated in FIG. 4, a last row 4E in the second crossing section T2 is configured such that when the rope R is wound, the width of the rope groove 4 decreases from 1 pitch to ½ pitch. Consequently, the rope R that had slipped into the rope groove 4 in the last row 4E of the first layer slips out of the rope groove 4 in the last row 4E and is pushed up into the first row of the second layer.

Figure 8:
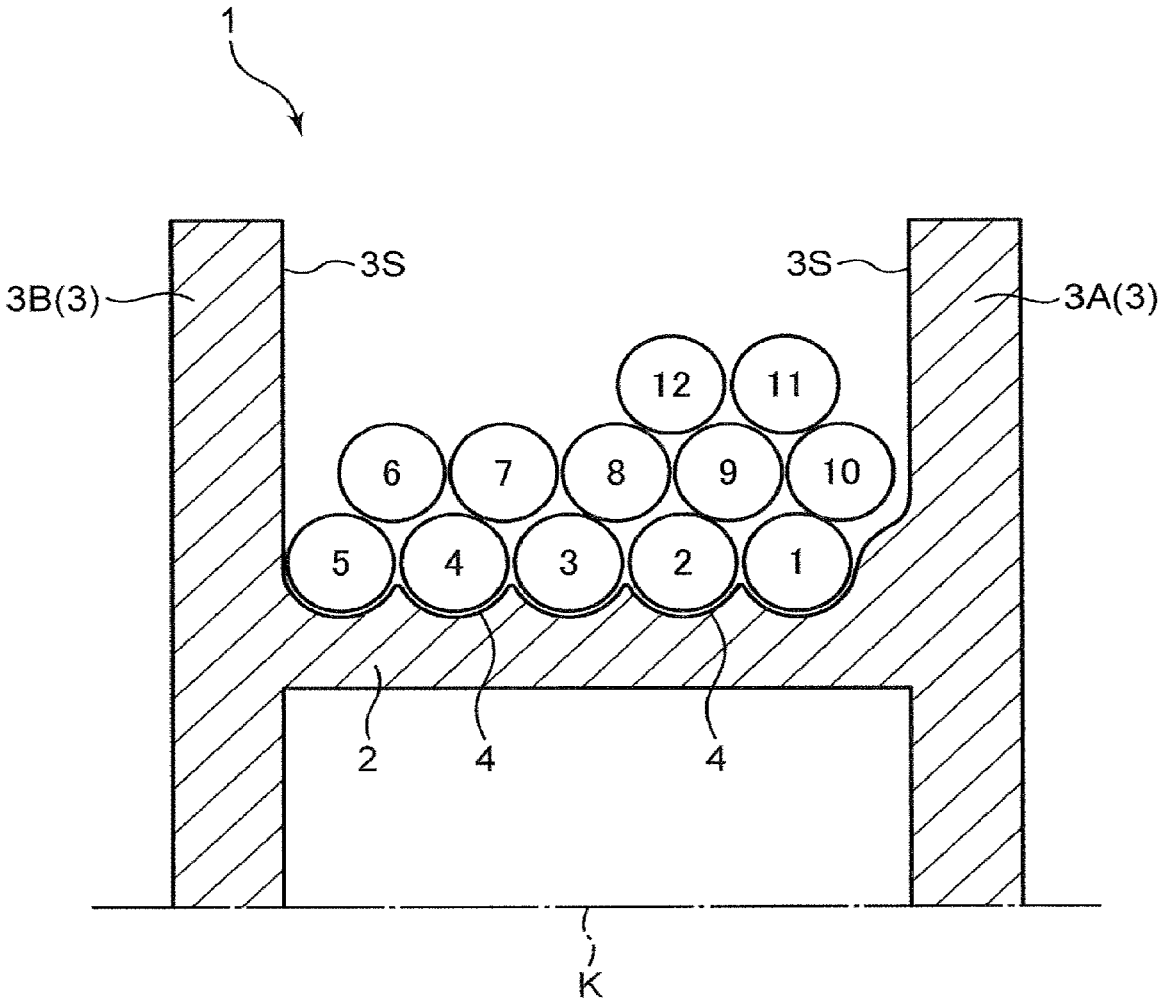
FIG. 8 is a diagrammatic view illustrating how the rope is arranged at the position P3 in FIG. 7.

When viewed from a plan view as illustrated in FIG. 3, the rope portion in a higher layer (for example, the rope portion R12 in the third layer in FIGS. 3 and 8) is parallel to the two adjacent rope portions in the lower layer below the rope portion R12 (for example, the rope portion R9 and the rope portion R10 in the second layer in FIG. 3) in the first parallel section S1 illustrated in FIG. 4, and as illustrated in FIGS. 3 and 8, is positioned directly above the valley formed by these rope portions R9 and R10. Also, when viewed from a plan view as illustrated in FIG. 3, the rope portion in a higher layer (for example, the rope portion R12 in the third layer in FIGS. 3 and 8) is parallel to the two adjacent rope portions in the lower layer below the rope portion R12 (for example, the rope portion R8 and the rope portion R9 in the second layer in FIG. 3) in the second parallel section S2 illustrated in FIG. 4, and as illustrated in FIGS. 3 and 8, is positioned directly above the valley formed by these rope portions R8 and R9. In other words, in the first parallel section S1 and the second parallel section S2, the rope portion R in a higher layer is at a position shifted in the width direction W by ½ pitch with respect to the rope portions R in a lower layer directly below.

When viewed from a plan view as illustrated in FIG. 3, the rope portion in a higher layer (for example, the rope portion R12 in the third layer in FIG. 3) crosses a rope portion in the lower layer below the rope portion R12 (for example, the rope portion R9 in the second layer in FIG. 3) in the first crossing section T1 illustrated in FIG. 4. Similarly, when viewed from a plan view, a rope portion in a higher layer crosses a rope portion in a lower layer in the second crossing section T2 illustrated in FIG. 4.

The first parallel section S1 is provided in a region occupying ⅓ of the outer circumferential surface 20 of the winding drum 2 in the circumferential direction. The second parallel section S2 is provided in a region occupying another ⅓ of the outer circumferential surface 20 of the winding drum 2 in the circumferential direction. The first crossing section T1 is provided in a region occupying ⅙ of the outer circumferential surface 20 of the winding drum 2 in the circumferential direction. The second crossing section T2 is provided in a region occupying another ⅙ of the outer circumferential surface 20 of the winding drum 2 in the circumferential direction.

In other words, in a cross section perpendicular to the rotation axis K in the outer circumferential surface 20 of the winding drum 2, the central angle joining both ends in the circumferential direction of the first parallel section S1 to the rotation axis K is 120 degrees, and the central angle joining both ends in the circumferential direction of the second parallel section S2 to the rotation axis K is 120 degrees. Also, the central angle joining both ends in the circumferential direction of the first crossing section T1 to the rotation axis K is 60 degrees, and the central angle joining both ends in the circumferential direction of the second crossing section T2 to the rotation axis K is 60 degrees. However, the ranges over which the parallel sections S1 and S2 and the crossing sections T1 and T2 are provided are not limited to the specific example above.

Figure 6:
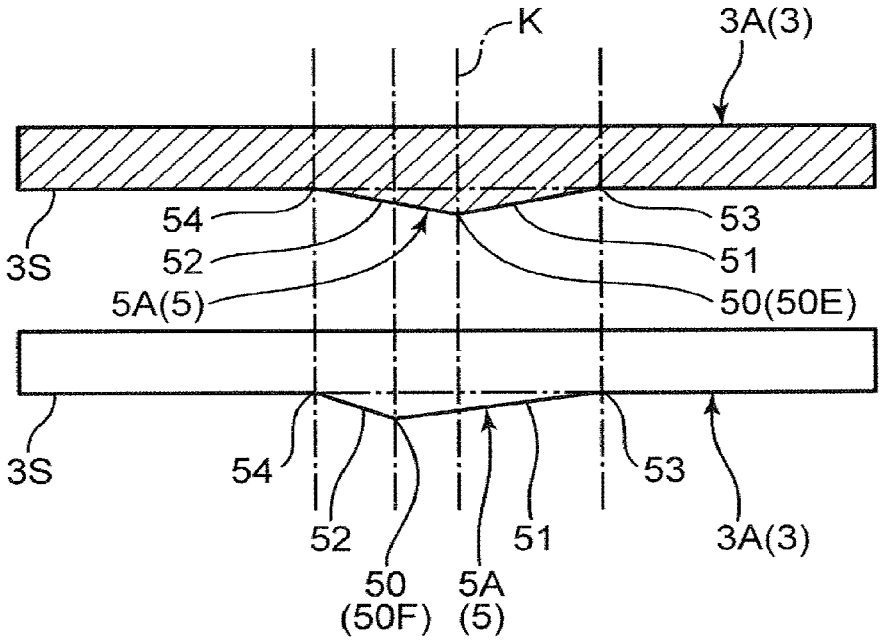
FIG. 6 is a diagram for explaining features of a rope guide part provided on a flange of the winch drum according to the first embodiment, in which the upper diagram is a cross section illustrating the flange when viewed in the direction of the arrow at the position of the line A-A in FIG. 5, and the lower diagram is a plan view illustrating the flange when viewed in the direction of the arrow at the position of the line B-B in FIG. 5.

As illustrated in FIG. 3, in the winch drum 1, on the inner face 3S (inward surface) of the first flange 3A, a rope guide part 5 (first rope guide part 5A) referred to as a rope kick is provided projecting inward, that is, toward the second flange 3B. On the inner face 3S (inward surface) of the second flange 3B, a similar rope guide part 5 (second rope guide part 5B) is provided projecting inward, that is, toward the first flange 3A. The cross section of each rope guide part 5 presents a triangular shape as illustrated in FIG. 6 for example. As illustrated in FIG. 4, the rope guide part 5 is provided only in the first crossing section T1, and is not provided in the second crossing section T2, the first parallel section S1, and the second parallel section S2.

The first rope guide part 5A and the second rope guide part 5B are formed to have plane symmetry with respect to a plane positioned centrally between the first flange 3A and the second flange 3B and also perpendicular to the rotation axis K. The first rope guide part 5A and the second rope guide part 5B are provided at positions facing opposite each other in the width direction W. Consequently, in the following, the first rope guide part 5A mainly will be described.

Figure 5:
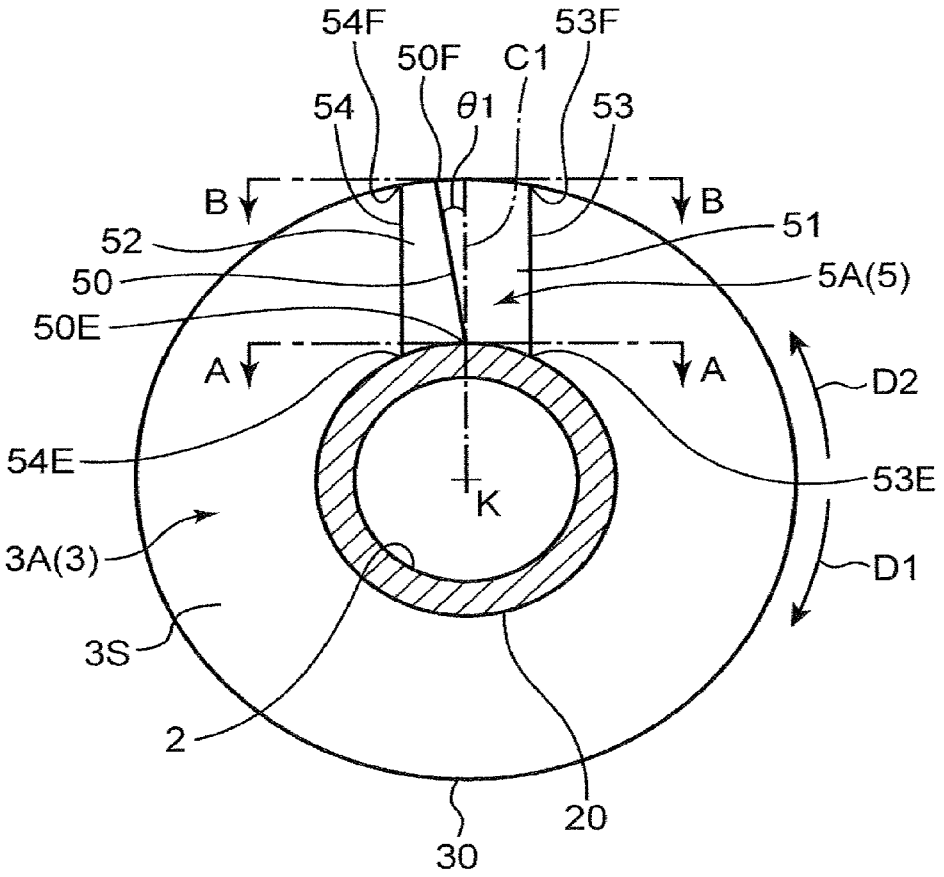
FIG. 5 is a cross section taken along the line V-V of the winch drum in FIG. 3.

FIG. 5 is a cross section taken along the line V-V of the winch drum 1 in FIG. 3. FIG. 6 is a diagram for explaining features of a rope guide part 5 provided on a flange 3 of the winch drum 1 according to the first embodiment. The upper diagram in FIG. 6 is a cross section illustrating the flange 3 when viewed in the direction of the arrow at the position of the line A-A in FIG. 5, and the lower diagram in FIG. 6 is a plan view illustrating the flange 3 when viewed in the direction of the arrow at the position of the line B-B in FIG. 5.

As illustrated in FIG. 5, the rope guide part 5 is provided continuously from the outer circumferential surface 20 of the winding drum 2 to the outer circumference 30 of the flange 3. However, it is sufficient to provide the rope guide part 5 at a position where the rope R exists when the rope R is wound in a plurality of layers. Consequently, the rope guide part 5 may also be provided only between a position farther radially outward than the outer circumferential surface 20 of the winding drum 2 and a position farther radially inward than an outer circumference 30 of the flange 3.

As illustrated in FIGS. 3 and 5, the rope guide part 5 includes a first inclined face 51 and a second inclined face 52. The first inclined face 51 and the second inclined face 52 are arranged in the circumferential direction. The inner sides of the first inclined face 51 and the second inclined face 52 are connected to each other at a ridge line 50. The first inclined face 51 exists in the winding rotation direction D1 from the ridge line 50, while the second inclined face 52 exists in the opposite direction D2 of the winding rotation direction D1 from the ridge line 50. The first inclined face 51 is a face that opposes the rope R when winding the rope R. The second inclined face 52 is a face adjacent to the first inclined face 51 in the opposite direction D2 of the winding rotation direction D1, and opposes the rope R later than the first inclined face 51 when winding the rope R.

The first inclined face 51 has an outer side 53 at a position shifted in the winding rotation direction D1 from the ridge line 50. The outer side 53 has an inner edge 53E positioned near the outer circumferential surface 20 of the winding drum 2 and an outer edge 53F positioned closer to the outer circumference 30 of the flange 3 than the inner edge 53E. The outer side 53 lies on the same plane as the inner face 3S of the flange 3. The inner face 3S of the flange 3 is parallel to the plane perpendicular to the rotation axis K. On the other hand, the first inclined face 51 is inclined with respect to the plane perpendicular to the rotation axis K. Specifically, the first inclined face 51 on the first rope guide part 5A of the first flange 3A is inclined with respect to the inner face 3S of the flange 3 (the plane perpendicular to the rotation axis K) to be positioned farther inward in the width direction W of the winding drum 2 (toward the second flange 3B) as proceeding from the outer side 53 to the ridge line 50. The first inclined face 51 on the second rope guide part 5B is inclined with respect to the inner face 3S of the flange 3 (the plane perpendicular to the rotation axis K) to be positioned farther inward in the width direction W of the winding drum 2 (toward the first flange 3A) as proceeding from the outer side 53 to the ridge line 50.

The second inclined face 52 has an outer side 54 at a position shifted in the opposite direction D2 of the winding rotation direction D1 from the ridge line 50. The outer side 54 of the second inclined face 52 has an inner edge 54E positioned near the outer circumferential surface 20 of the winding drum 2 and an outer edge 54F positioned closer to the outer circumference 30 of the flange 3 than the inner edge 54E. The outer side 54 lies on the same plane as the inner face 3S of the flange 3.

The second inclined face 52 is inclined with respect to the plane perpendicular to the rotation axis K. Specifically, the second inclined face 52 on the first rope guide part 5A of the first flange 3A is inclined with respect to the inner face 3S of the flange 3 (the plane perpendicular to the rotation axis K) to be positioned farther inward in the width direction W of the winding drum 2 (toward the second flange 3B) as proceeding from the outer side 54 to the ridge line 50. The second inclined face 52 on the second rope guide part 5B of the second flange 3B is inclined with respect to the inner face 3S of the flange 3 (the plane perpendicular to the rotation axis K) to be positioned farther inward in the width direction W of the winding drum 2 (toward the first flange 3A) as proceeding from the outer side 54 to the ridge line 50.

The ridge line 50 extends between the outer circumferential surface 20 of the winding drum 2 and the outer circumference 30 of the flange 3, from a position closer to the outer circumferential surface 20 of the winding drum 2 than the outer circumference 30 of the flange 3 to a position closer to the outer circumference 30 of the flange 3 than the outer circumferential surface 20 of the winding drum 2. In the specific example illustrated in FIG. 5, the ridge line 50 is provided from the outer circumferential surface 20 of the winding drum 2 to the outer circumference 30 of the flange 3. However, it is sufficient to provide the ridge line 50 at a position where the rope R exists when the rope R is wound in a plurality of layers, and the ridge line 50 does not necessarily have to be provided out to the position of the outer circumference 30 of the flange 3.

The ridge line 50 has an inner edge 50E near the outer circumferential surface 20 of the winding drum 2 and an outer edge 50F near the outer circumference 30 of the flange 3. Herein, the chain line C1 illustrated in FIG. 5 is a straight line passing through the rotation axis K and the inner edge 50E of the ridge line 50, and parallel to the radial direction of the which drum 1. The chain line C1 is hereinafter referred to as the baseline C1. Also, as illustrated in FIGS. 4 and 5, in the first embodiment, the baseline C1 is a straight line passing through the center of the first crossing section T1 in the circumferential direction of the winding drum 2.

The ridge line 50 has a shape that is displaced in the opposite direction D2 of the winding rotation direction D1 with respect to the baseline C1 as proceeding from the inner edge 50E to the outer edge 50F. In the first embodiment illustrated in FIG. 5, the ridge line 50 is a straight line.

As illustrated in FIG. 5, an inclination angle θ1 of the ridge line 50 with respect to the baseline C1 when viewing the flange 3A in the direction of the rotation axis K is not limited, but is preferably in the range from 10° to 20°, more preferably in the range from 12° to 18°, and even more preferably in the range from 14° to 16°. In the case where the inclination angle θ1 is less than 10°, the effect of improving the winding state of the rope R when the diameter of the rope R has decreased may be inadequate. On the other hand, in the case where the inclination angle θ1 exceeds 20°, variations in the timing when the ridge line 50 of the rope guide part 5 pushes the rope R may be too large.

The first inclined face 51 may be a flat face, a curved face, or a combination of the two. Similarly, the second inclined face 52 may be a flat face, a curved face, or a combination of the two. Each rope guide part 5 may have only the single ridge line 50 and no multiple ridge lines. The ridge line 50 is provided only in the opposite direction D2 of the winding rotation direction D1 with respect to the baseline C1.

In the first embodiment illustrated in FIGS. 5 and 6, the outer side 53 of the first inclined face 51 is a straight line at a position shifted in the winding rotation direction D1 from the baseline C1 and parallel to the baseline C1. Also, the outer side 54 of the second inclined face 52 is a straight line at a position shifted in the opposite direction D2 of the winding rotation direction D1 from the baseline C1 and parallel to the baseline C1. When viewing the flange 3 in the direction of the rotation axis K illustrated in FIG. 5, the baseline C1 is positioned centrally between the outer side 53 of the first inclined face 51 and the outer side 54 of the second inclined face 52.

In FIG. 3, L1 is the inner face-to-face dimension (guide-to-guide dimension) between the first flange 3A and the second flange 3B. Specifically, L1 indicates the guide-to-guide dimension in the portion where a ridge line 50 of a first rope guide part 5A and a ridge line 50 of a second rope guide part 5B exist. The guide-to-guide dimension L1 is set to a dimension determined by multiplying the number of rows of the rope in each layer by the rope diameter. Consequently, in the portion where the ridge lines 50 of the rope guide parts 5 exist, the rope R is in a state in which the ropes in higher and lower layers almost overlap each other vertically, as illustrated in FIG. 3, while in the portion where the rope R corresponds to the first parallel section S1 and the second parallel section S2, the higher-layer rope is positioned in the valley between formed by the lower-layer rope.

FIG. 3 illustrates a case where the diameter of the rope R is the ideal dimension as designed like the above. In such a case, the rope R is wound around the winch drum 1 as follows. First, of the rope R, the rope portions R1 to R5 in the first layer are neatly wound by slipping into the rope groove 4. Thereafter, the rope portion R6 in the first row of the second layer moves from a position closer to the flange 3B than the rope portion R5 in the first layer and is guided by the rope guide part 5B to move directly above the rope portion R5, and is furthermore guided by the rope guide part 5B to move directly above the valley formed by the rope portion R4 (not illustrated in FIG. 3) and the rope portion R5 in the first layer. With this arrangement, rope portions R6 to R10 in the second layer are neatly wound. Thereafter, the rope portion R11 in the first row of the third layer is guided by the rope guide part 5A similarly to the case of the rope portion R6, and moves directly above the valley formed by the rope portion R9 and the rope portion R10 in the second layer. With this arrangement, rope portions R11 to R15 in the third layer are neatly wound.

Figure 7:
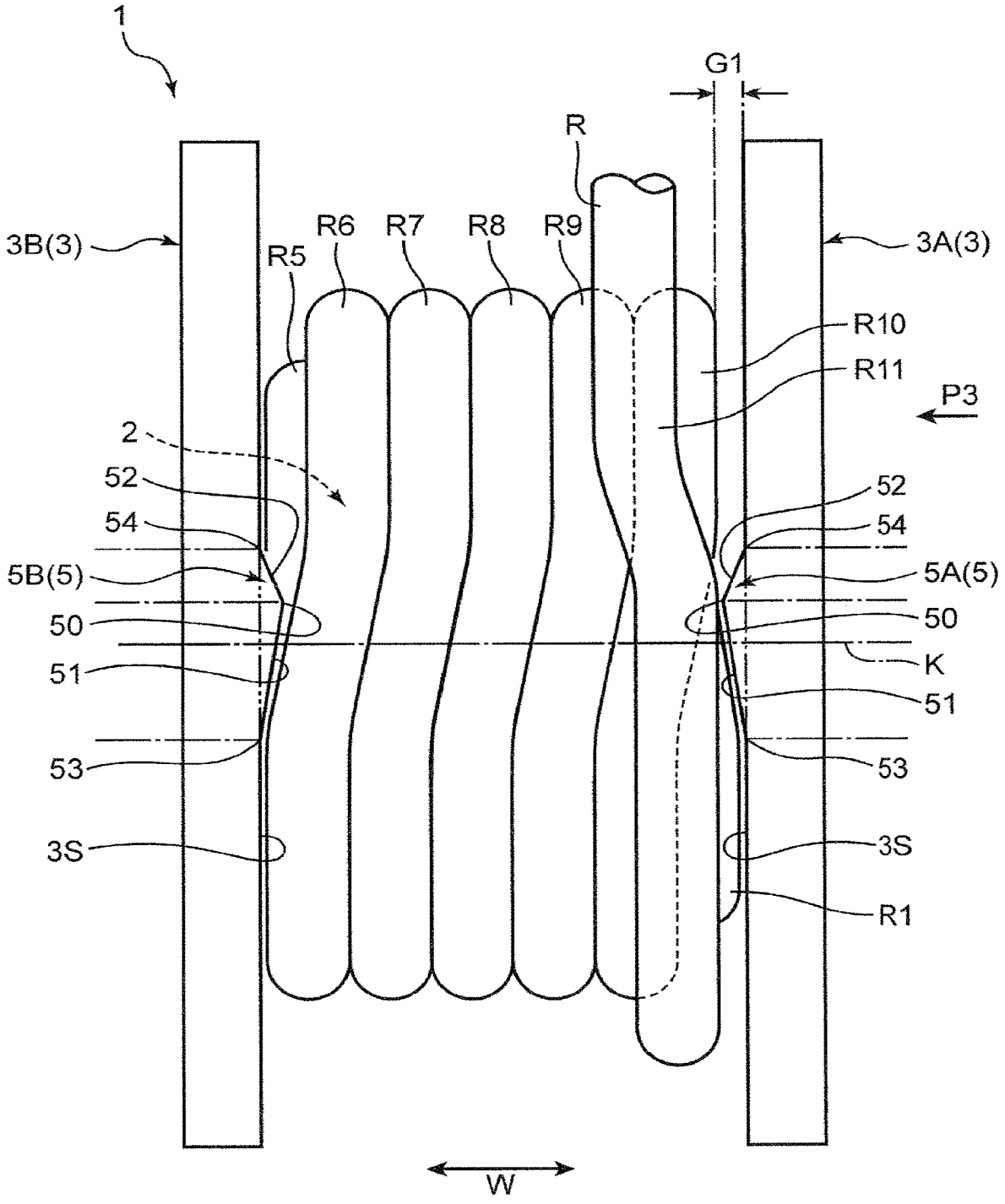
FIG. 7 is a plan view illustrating a winch drum according to the first embodiment, and is a diagram illustrating a state in which a gap has formed between the rope and the flange because of a decrease in the diameter of the rope.

FIG. 7 is a plan view illustrating the winch drum 1 according to the first embodiment. FIG. 7 is a diagram illustrating a state in which the gap G1 has formed between the rope R and the flange 3A because of a decrease in the diameter of the rope R. Compared to the case where the diameter of the rope R is the ideal dimension as illustrated in FIG. 3, if the diameter of the rope R becomes smaller as illustrated in FIG. 7, the rope portions R6 to R10 in the second layer for example arc positioned nearer the flange 3B. As a result, the gap G1 between the rope portion R10 in the last row (fifth row) of the second layer and the flange 3A increases.

For this reason, in the hypothetical case where the ridge line 250 of the rope guide part 205 lies on a straight line passing through the rotation axis K and parallel to the radial direction of the winch drum 1 like the winch drum according to the comparative example illustrated in FIG. 16, or in other words, in the case where the ridge line 250 is positioned on the baseline C1, as illustrated in FIGS. 21 and 22, the rope portion R11 in the first row of the third layer cannot be positioned directly above the rope portion R10 in the lower layer (second layer) even at the position opposing the ridge line 250 of the rope guide part 205, and exists at a position shifted toward the flange 203A. As a result, as illustrated in FIG. 23, the large gap G2 is foamed between the rope portion R11 in the first row and the rope portion R12 in the second row of the third layer.

On the other hand, in the first embodiment, as illustrated in FIG. 5, the ridge line 50 of the rope guide part 5 has a shape that is displaced in the opposite direction D2 of the winding rotation direction D1 with respect to the baseline C1 as proceeding from the inner edge 50E to the outer edge 50F of the ridge line 50. Consequently, as illustrated in FIG. 7, even if the gap G1 between the rope portion R10 in the last row of the second layer and the flange 3A becomes large, the rope portion R11 in the first row of the third layer can be positioned substantially above the rope portion R10 in the lower layer at the position corresponding to the ridge line 50 of the rope guide part 5. The reason is that in the first crossing section T1 in the lebus type winch drum 1, the rope portion R10 in the lower layer is disposed to approach the inner face 3S of the first flange 3A as proceeding from a position near the outer side 53 of the first inclined face 51 toward the outer side 54 of the second inclined face 52.

Consequently, in the first embodiment, because the guiding effect provided by the rope guide part 5A can be effectively obtained, as illustrated in FIG. 7, the rope portion R11 in the first row of the third layer can cross over the rope portion R10 in the second layer inwardly in the width direction W and move directly above the valley formed by the rope portion R9 and the rope portion R10 in the second layer. With this arrangement, even in the case where the diameter of the rope R becomes smaller compared to the ideal dimension, it is possible to suppress the occurrence of problems such as the formation of a large gap G2 between the rope portion R11 in the first row and the rope portion R12 in the second row of the third layer like the winch drum according to the comparative example illustrated in FIG. 23.

Also, another reason why the ridge line 50 is inclined with respect to the baseline C1 as illustrated in FIG. 5 in the first embodiment is to address problems like the following. Namely, the decrease in the diameter of the rope R compared to the ideal dimension causes a problem in which, among the plurality of layers formed by the rope R wound around the winding drum 2, the gap G1 between the rope R and the flange 3 cumulatively increases in the layers positioned farther radially outward. In other words, in the lebus type winch drum 1, the rope portion R in higher layer is basically wound by using the valley between two adjacent rope portions R in a lower layer as rail. For this reason, the arrangement state of the rope portion R in higher layer is influenced to some degree by the arrangement state of the rope portions R in lower layer. Consequently, if an arrangement state is foamed whereby the gap G1 is formed between the rope portion R in the last row of a certain layer and the inner face 3S of the flange 3, the arrangement in the higher layer is influenced by the arrangement state in the lower layer, and the arrangement in the next higher layer is influenced by the arrangement in the two lower layers. In this way, there is a tendency for the gap between the rope portion R in the last row and the inner face 3S of the flange 3 to accumulate in layers positioned farther radially outward of the winding drum 2 among the plurality of layers. Consequently, there is a tendency for the gap G1 between the rope portion R in the last row and the inner face 3S of the flange 3 to increase in layers positioned farther radially outward.

To address such a problem of the accumulation of the gap G1, the present embodiment adopts a configuration in which the ridge line 50 has a shape that is displaced in the opposite direction D2 of the winding rotation direction D1 with respect to the baseline C1 as proceeding from the inner edge 50E to the outer edge 50F. With this arrangement, the distance by which the ridge line 50 of the rope guide part 5 diverges from the baseline C1 in the opposite direction D2 of the winding rotation direction D1 increases as proceeding radially outward. Consequently, even in the case where the gap G1 between the rope portion R in the last row and the inner face 3S of the flange 3 cumulatively increases in layers positioned farther radially outward among the plurality of layers, the distance described above can be increased according to the cumulative size of the gap G1. With this arrangement, even in a layer positioned radially outward where the gap G1 is increased, the rope portion R in the first row crosses over the rope portion R in the last row of the lower layer inwardly in the width direction W and is disposed in the proper position, and the rope R can be neatly wound. As a result, in the first embodiment, the rope R can be neatly wound as illustrated in FIG. 8.

SECOND EMBODIMENT

Figure 9:
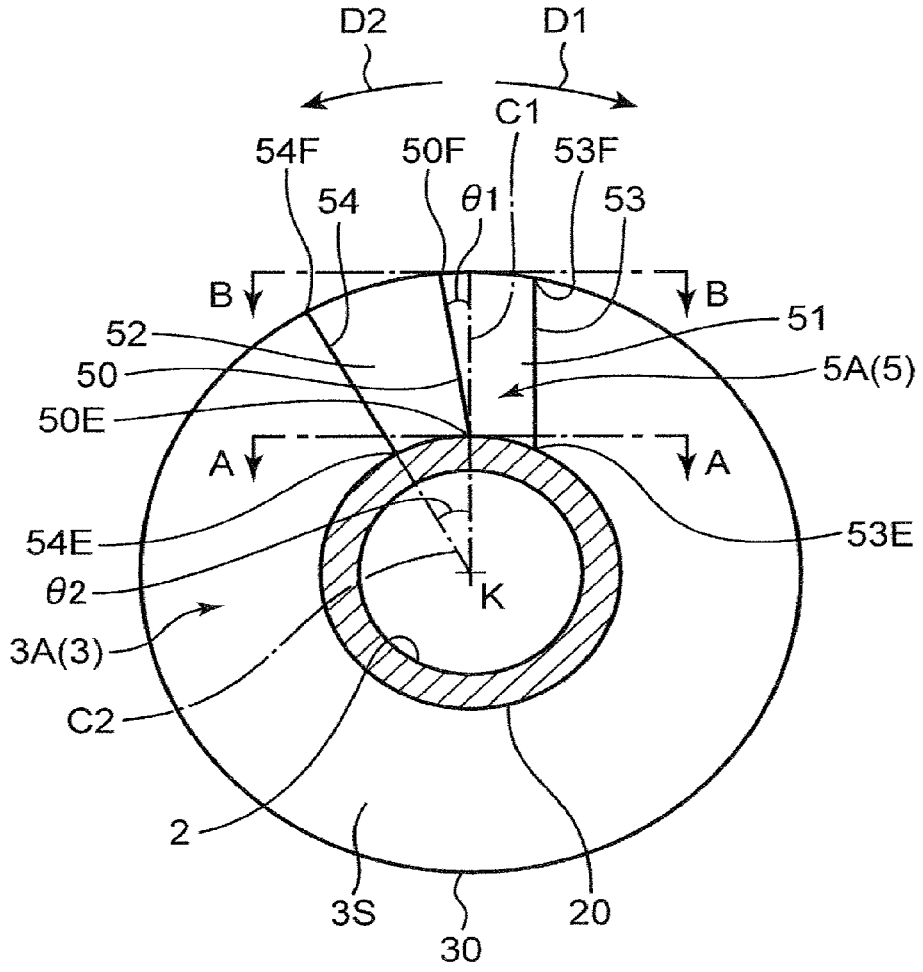
FIG. 9 is a cross section illustrating a winch drum according to a second embodiment of the present invention.
Figure 10:
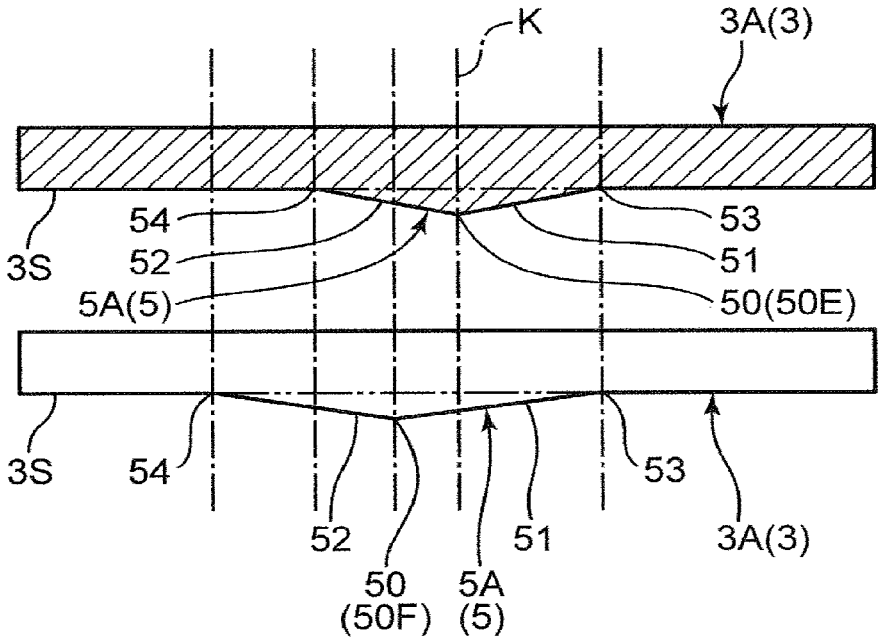
FIG. 10 is a diagram for explaining features of a rope guide part provided on a flange of the winch drum according to the second embodiment, in which the upper diagram is a cross section illustrating the flange when viewed in the direction of the arrow at the position of the line A-A in FIG. 9, and the lower diagram is a plan view illustrating the flange when viewed in the direction of the arrow at the position of the line B-B in FIG. 9.

FIG. 9 is a cross section illustrating the winch drum 1 according to the second embodiment of the present invention. FIG. 10 is a diagram for explaining features of a rope guide part 5 provided on a flange 3 of the winch drum 1 according to the second embodiment. The upper diagram in FIG. 10 is a cross section illustrating the flange when viewed in the direction of the arrow at the position of the line A-A in FIG. 9, and the lower diagram in FIG. 10 is a plan view illustrating the flange when viewed in the direction of the arrow at the position of the line B-B in FIG. 9.

In the winch drum 1 according to the second embodiment, the configuration of the rope guide part 5 is different from the first embodiment, but otherwise the configuration is similar to the first embodiment. Consequently, in the following description, the parts of the configuration that differ from the first embodiment discussed above will be described mainly, and a description will be omitted for parts of the configuration that are similar to the first embodiment.

As illustrated in FIGS. 9 and 10, in the rope guide part 5 according to the second embodiment, the outer side 54 of the second inclined face 52 is not a straight line parallel to the baseline C1 like in the first embodiment, but instead is inclined with respect to the baseline C1, unlike the first embodiment.

As illustrated in FIG. 9, in the second embodiment, the outer side 54 of the second inclined face 52 has an inner edge 54E positioned on the winding drum 2 side and an outer edge 54F positioned closer to the outer circumference 30 of the flange 3 than the inner edge 54E. The outer side 54 of the second inclined face 52 has a shape that is inclined with respect to the baseline C1 such that the distance between the outer edge 54F of the second inclined face 52 and the baseline C1 is greater than the distance between the inner edge 54E of the second inclined face 52 and the baseline C1. Specifically, the outer side 54 of the second inclined face 52 has a shape that is displaced in the opposite direction D2 of the winding rotation direction D1 with respect to the baseline C1 as proceeding from the inner edge 54E to the outer edge 54F. More specifically, the outer side 54 of the second inclined face 52 lies on a straight line C2 (chain line C2) passing through the rotation axis K and parallel to the radial direction of the winch drum 1.

As illustrated in FIG. 9, an inclination angle θ2 of the outer side 54 with respect to the baseline C1 when viewing the flange 3A in the direction of the rotation axis K, that is the inclination angle θ2 on a straight line C2 with respect to the baseline C1 is not limited, but is preferably in the range from 25° to 35°, more preferably in the range from 27.5° to 32.5°, and even more preferably in the range from 29° to 31°. In the case where the inclination angle θ2 is less than 25°, the effect of improving the winding state of the rope R when the diameter of the rope R has decreased may be inadequate. On the other hand, in the case where the inclination angle θ2 exceeds 35°, variations in the timing when the ridge line 50 of the rope guide part 5 pushes the rope R may be too large.

As illustrated in FIG. 9, in the second embodiment, the distance by which the outer side 54 of the second inclined face 52 diverges from the baseline C1 in the opposite direction D2 of the winding rotation direction D1 increases as proceeding from the inner edge 54E to the outer edge 54F of the outer side 54. Consequently, compared to the case where the outer side 54 is parallel to the baseline C1 like the first embodiment illustrated in FIGS. 5 and 6, the second embodiment illustrated in FIGS. 9 and 10 has characteristics like the following. Namely, in the second embodiment, it is possible to provide the second inclined face 52 at a position more distant from the baseline C1 in the opposite direction D2 of the winding rotation direction D1 compared to the first embodiment. In other words, in the second embodiment, it is possible to provide the rope guide part 5 having a thickness in the direction of the rotation axis K even at a position more distant from the baseline C1 in the opposite direction D2 of the winding rotation direction D1 compared to the first embodiment. The range over which the rope guide part 5 having such a thickness can be provided increases as proceeding from the inner edge 54E to the outer edge 54F of the outer side 54. Imparting such a thickness has advantages like the following.

Namely, there is a tendency for the gap G1 between the rope portion R in the last row and the inner face 3S of the flange 3 to cumulatively increase in layers positioned farther radially outward among the plurality of layers thinned by the rope R wound around the winding drum 2 as described above. This causes a tendency whereby the rope portion R in the first row of a higher layer less easily crosses over the rope portion R in the last row of a lower layer inwardly in the width direction W in layers positioned farther radially outward. Even in such a case, in the second embodiment, a thickness is imparted to the portion corresponding to the second inclined face 52 of the rope guide part 5 even at positions more distant from the baseline C1 in the opposite direction D2 of the winding rotation direction D1 in layers positioned farther radially outward, and the imparted thickness makes it easy for the rope portion R in the first row of the higher layer to cross over the rope portion R in the last row of the lower layer inwardly in the width direction W. Also, the thickness imparted in this way also serves a role of suppressing a motion in which the rope portion R in the first row of a higher layer that has crossed over the rope portion R in the last row of a lower layer crosses over the rope portion R in the lower layer in the opposite direction (outwardly in the width direction W) and returns to a position near the inner face 3S of the flange 3.

THIRD EMBODIMENT

Figure 11:
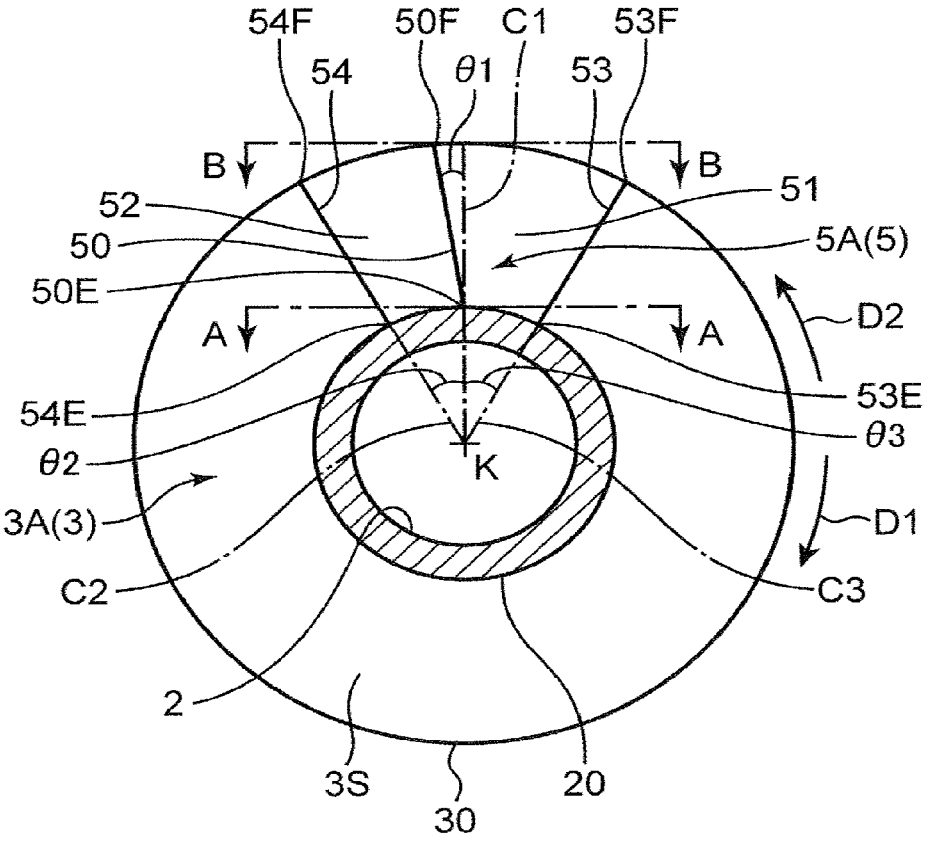
FIG. 11 is a cross section illustrating a winch drum according to a third embodiment of the present invention.
Figure 12:
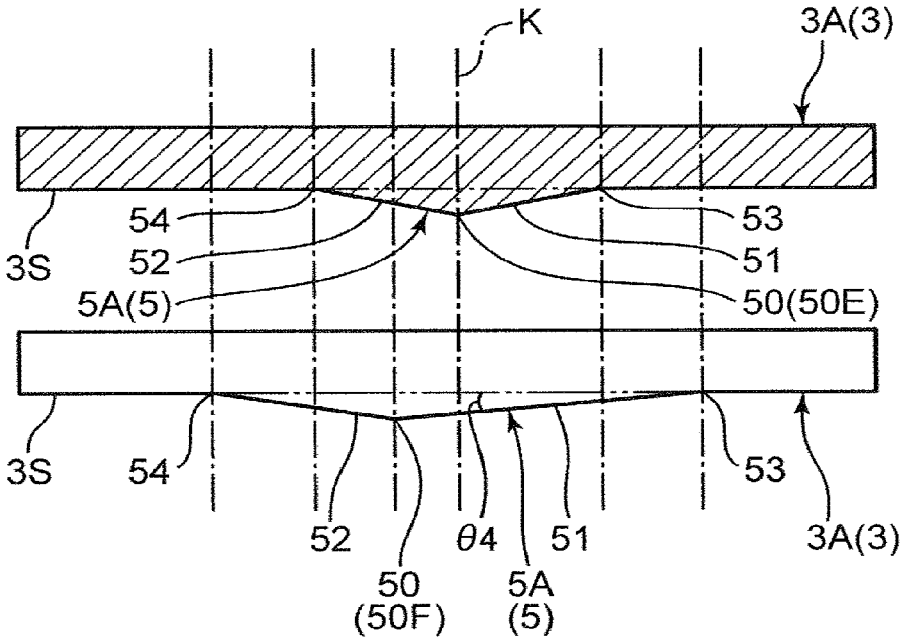
FIG. 12 is a diagram for explaining features of a rope guide part provided on a flange of the winch drum according to the third embodiment, in which the upper diagram is a cross section illustrating the flange when viewed in the direction of the arrow at the position of the line A-A in FIG. 11, and the lower diagram is a plan view illustrating the flange when viewed in the direction of the arrow at the position of the line B-B in FIG. 11.

FIG. 11 is a cross section illustrating the winch drum 1 according to the third embodiment of the present invention. FIG. 12 is a diagram for explaining features of a rope guide part 5 provided on a flange 3 of the winch drum 1 according to the third embodiment. The upper diagram in FIG. 12 is a cross section illustrating the flange when viewed in the direction of the arrow at the position of the line A-A in FIG. 11, and the lower diagram in FIG. 12 is a plan view illustrating the flange when viewed in the direction of the arrow at the position of the line B-B in FIG. 11.

In the winch drum 1 according to the third embodiment, the configuration of the rope guide part 5 is different from the first embodiment, but otherwise the configuration is similar to the first embodiment. Consequently, in the following description, the parts of the configuration that differ from the first embodiment discussed above will be described mainly, and a description will be omitted for parts of the configuration that are similar to the first embodiment.

As illustrated in FIGS. 11 and 12, in the rope guide part 5 according to the third embodiment, the outer side 53 of the first inclined face 51 is not a straight line parallel to the baseline C1 like in the first embodiment, but instead is inclined with respect to the baseline C1, unlike the first embodiment. Further, the outer side 54 of the second inclined face 52 is not a straight line parallel to the baseline C1 like in the first embodiment, but instead is inclined with respect to the baseline C1, unlike the first embodiment. In the third embodiment, the characteristics of the outer side 54 of the second inclined face 52 are similar to those of the outer side 54 of the second inclined face 52 in the second embodiment, and therefore a description is omitted.

As illustrated in FIG. 11, in the third embodiment, the outer side 53 of the first inclined face 51 has an inner edge 53E positioned on the winding drum 2 side and an outer edge 53F positioned closer to the outer circumference 30 of the flange 3 than the inner edge 53E. The outer side 53 of the first inclined face 51 has a shape that is inclined with respect to the baseline C1 such that the distance between the outer edge 53F of the first inclined face 51 and the baseline C1 is greater than the distance between the inner edge 53E of the first inclined face 51 and the baseline C1. Specifically, the outer side 53 of the first inclined face 51 has a shape that is displaced in the winding rotation direction D1 with respect to the baseline C1 as proceeding from the inner edge 53E to the outer edge 53F. More specifically, the outer side 53 of the first inclined face 51 lies on a straight line C3 (chain line C3) passing through the rotation axis K and parallel to the radial direction of the winch drum 1.

As illustrated in FIG. 11, an inclination angle θ3 of the outer side 53 with respect to the baseline C1 when viewing the flange 3A in the direction of the rotation axis K, that is an inclination angle θ3 on a straight line C3 with respect to the baseline C1 is not limited, but is preferably in the range from 25° to 35°, more preferably in the range from 27.5° to 32.5°, and even more preferably in the range from 29° to 31°. Further, a total angle (θ2+θ3) including the angle θ2 and the angle θ3 is preferably in the range from 50° to 70°, more preferably in the range from 55° to 65°, and even more preferably in the range from 58° to 62°. In the case where the inclination angle θ3 is less than 25° or the total angle (θ2+θ3) is less than 50°, the effect of improving the winding state of the rope R when the diameter of the rope R has decreased may be inadequate. On the other hand, in the case where the inclination angle θ3 exceeds 35° or the total angle (θ2+θ3) exceeds 70°, variations in the timing when the ridge line 50 of the rope guide part 5 pushes the rope R may be too large.

As illustrated in FIG. 11, in the third embodiment, the distance by which the outer side 53 of the first inclined face 51 diverges from the baseline C1 in the winding rotation direction D1 increases as proceeding from the inner edge 53E to the outer edge 53F of the outer side 53. Consequently, in the third embodiment, an inclination angle θ4 (see FIG. 12) of the first inclined face 51 with respect to the inner face 3S of the flange 3 decreases as proceeding from the inner edge 53E to the outer edge 53F of the outer side 53 compared to the case where the outer side 53 of the first inclined face 51 is parallel to the baseline C1. The rope R used in the crane 100 normally has some degree of rigidity and is not very flexible. Consequently, if the inclination angle θ4 can be decreased, the rope R in the first row of a higher layer is guided smoothly along the first inclined face 51. In other words, the first inclined face 51 having a small inclination angle θ4 can guide the rope R in the higher layer such that the rope R in the higher layer crosses over the rope R in the last row of a lower layer inwardly in the width direction W while bending the rope R in the higher layer little by little. Consequently, in the third embodiment, the rope R can be made to cross over smoothly in layers positioned farther radially outward among the plurality of layers. This causes the rope portion R in the first row to cross over the rope portion R in the last row of the lower layer inwardly in the width direction W and be more easily disposed in the proper position, even in the case where the gap G1 between the rope portion R in the last row and the inner face 3S of the flange 3 cumulatively increases.

FOURTH EMBODIMENT

Figure 13:
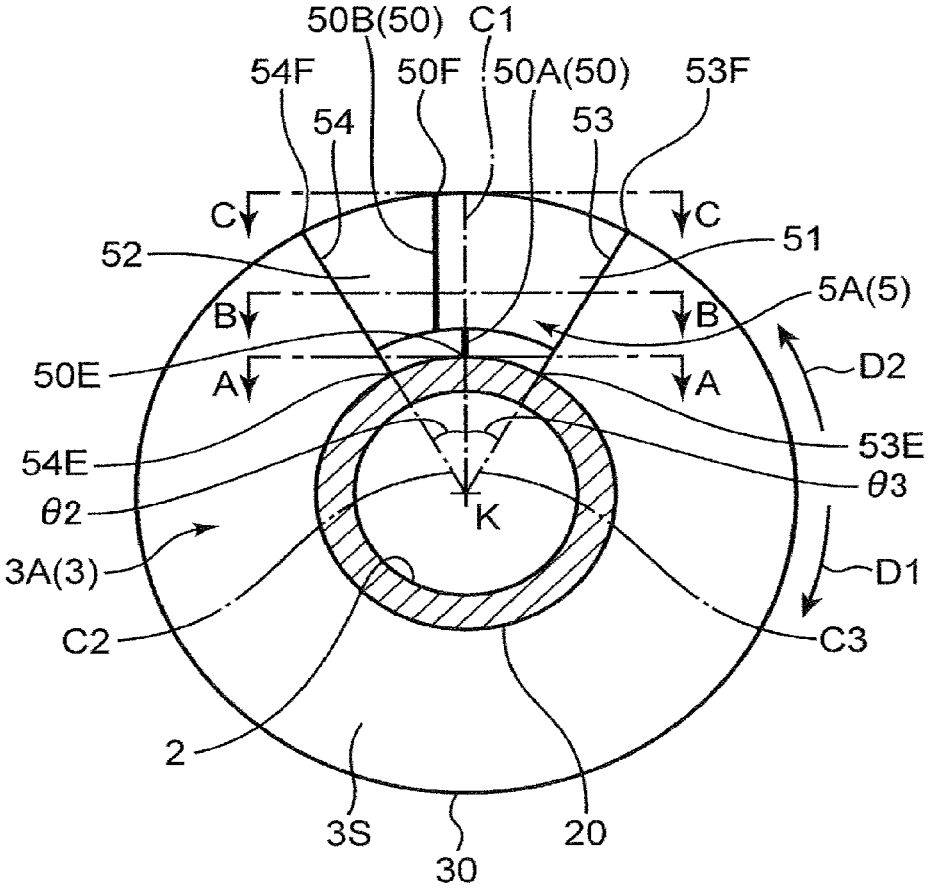
FIG. 13 is a cross section illustrating a winch drum according to a fourth embodiment of the present invention.
Figure 14:
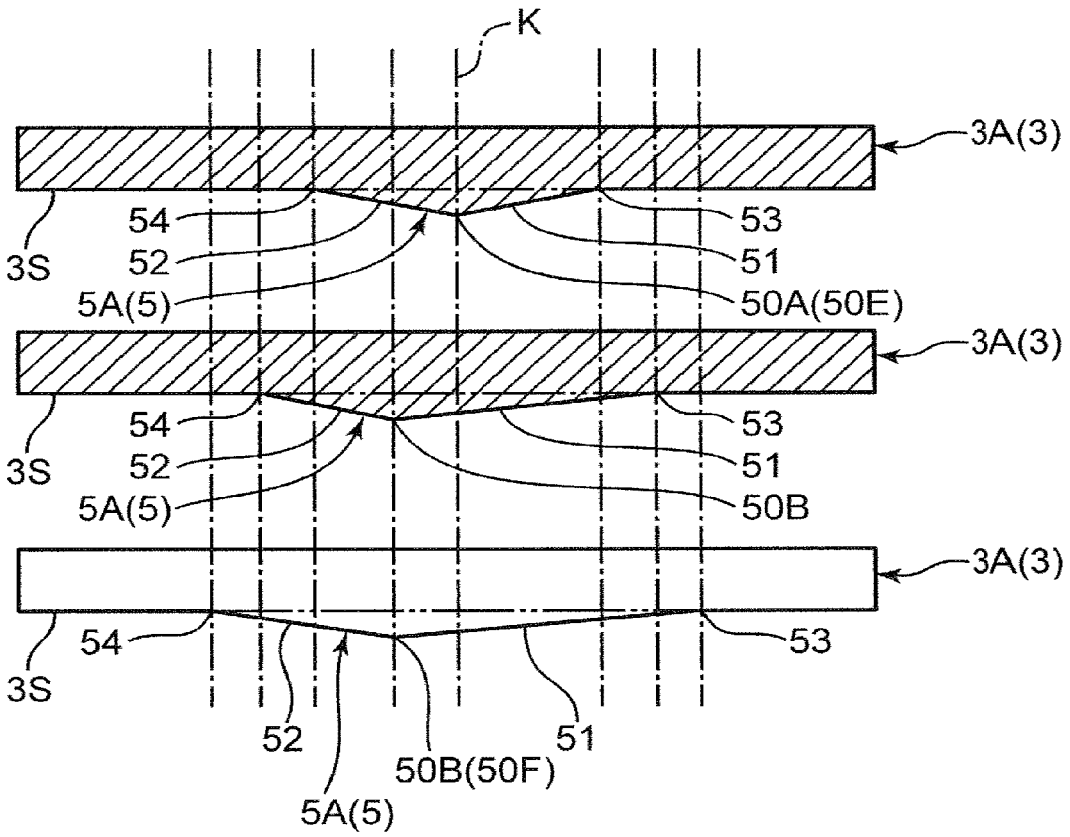
FIG. 14 is a diagram for explaining features of a rope guide part provided on a flange of the winch drum according to the fourth embodiment, in which the upper diagram is a cross section illustrating the flange when viewed in the direction of the arrow at the position of the line A-A in FIG. 13, the middle diagram is a cross section illustrating the flange when viewed in the direction of the arrow at the position of the line B-B in FIG. 13, and the lower diagram is a plan view illustrating the flange when viewed in the direction of the arrow at the position of the line C-C in FIG. 13.

FIG. 13 is a cross section illustrating the winch drum 1 according to the fourth embodiment of the present invention. FIG. 14 is a diagram for explaining features of a rope guide part 5 provided on a flange 3 of the winch drum 1 according to the fourth embodiment. The upper diagram in FIG. 14 is a cross section illustrating the flange when viewed in the direction of the arrow at the position of the line A-A in FIG. 13, and the middle diagram in FIG. 14 is a cross section illustrating the flange when viewed in the direction of the arrow at the position of the line B-B in FIG. 13, and the lower diagram in FIG. 14 is a plan view illustrating the flange when viewed in the direction of the arrow at the position of the line C-C in FIG. 13.

In the winch drum 1 according to the fourth embodiment, the configuration of the rope guide part 5 is different from the first embodiment, but otherwise the configuration is similar to the first embodiment. Consequently, in the following description, the parts of the configuration that differ from the first embodiment discussed above will be described mainly, and a description will be omitted for parts of the configuration that are similar to the first embodiment.

As illustrated in FIGS. 13 and 14, in the rope guide part 5 according to the fourth embodiment, a configuration of the ridge line 50 is different from the one of the first embodiment. Further, in the fourth embodiment, the outer side 53 of the first inclined face 51 is not a straight line parallel to the baseline C1 like in the first embodiment, but instead is inclined with respect to the baseline C1, unlike the first embodiment. Further, the outer side 54 of the second inclined face 52 is not a straight line parallel to the baseline C1 like in the first embodiment, but instead is inclined with respect to the baseline C1, unlike the first embodiment. In the fourth embodiment, the characteristics of the outer side 53 of the first inclined face 51 are similar to those of the outer side 53 of the first inclined face 51 in the third embodiment, and the characteristics of the outer side 54 of the second inclined face 52 are similar to those of the outer side 54 of the second inclined face 52 in the second embodiment and the third embodiment, and therefore a description is omitted.

As illustrated in FIGS. 13 and 14, the ridge line 50 of the rope guide part 5 according to the fourth embodiment has a shape that is displaced in the opposite direction D2 of the winding rotation direction D1 with respect to the baseline C1 as proceeding from the inner edge 50E to the outer edge 50F. Specifically, the ridge line 50 has a first ridge line part 50A and a second ridge line part 50B. The first ridge line part 50A is positioned on the winding drum 2 side, while the second ridge line part 50B is positioned closer to the outer circumference 30 of the flange 3 than the first ridge line part 50A. Among the plurality of layers formed by the rope R wound around the winding drum 2, the first ridge line part 50A is provided at a position corresponding to the rope R in the first layer, while the second ridge line part 50B is provided at a position corresponding to the rope R in the second and higher layers.

As illustrated in FIG. 13, when the flange 3A is viewed in the direction of the rotation axis K, the first ridge line part 50A is positioned on the baseline C1. The second ridge line part 50B is at a position shifted in the opposite direction D2 of the winding rotation direction D1 with respect to the baseline C1. The first ridge line part 50A and the second ridge line part 50B both extend linearly in a direction parallel to the baseline C1.

In the fourth embodiment, the first inclined face 51 includes a face joining the outer side 53 and the first ridge line part 50A in the circumferential direction and a face joining the outer side 53 and the second ridge line part 50B in the circumferential direction. Also, the second inclined face 52 includes a face joining the outer side 54 and the first ridge line part 50A in the circumferential direction and a face joining the outer side 54 and the second ridge line part 50B in the circumferential direction.

In the fourth embodiment, of the ridge line 50, the first ridge line part 50A is positioned on the baseline C1 while the second ridge line part 50B is at a position shifted in the opposite direction D2 of the winding rotation direction D1 with respect to the baseline C1. This makes it possible to shift the position where the second ridge line part 50B opposes the rope R farther in the opposite direction D2 of the winding rotation direction D1 from the position of the baseline C1 than the position where the first ridge line part 50A opposes the rope R. In other words, at the point in time when the winch drum 1 rotates the same angle as the angle at which the rope R opposes the first ridge line part 50A, the rope R in the layers corresponding to the position where the second ridge line part 50B is provided do not yet oppose the second ridge line part 50B, and will oppose the second ridge line part 50B at a later point in time. Consequently, for reasons similar to the reasons described in the first embodiment, the rope R can be wound neatly even in the case where the diameter of the rope R decreases compared to the ideal dimension.

OTHER MODIFICATIONS

The present invention is not limited to the embodiments described above. The present invention includes configurations like the following, for example.

The second to fourth embodiments illustrate a case in which the outer side 54 of second inclined face lies on the straight line C2 passing through the rotation axis K and parallel to the radial direction of the winch drum 1, but the configuration is not limited thereto. The outer side 54 does not have to be parallel to the straight line C2.

The third to fourth embodiments illustrate a case in which the outer side 53 of first inclined face lies on the straight line C3 passing through the rotation axis K and parallel to the radial direction of the winch drum 1, but the configuration is not limited thereto. The outer side 53 does not have to be parallel to the straight line C3.

Also, at least one of the outer side 53 of the first inclined face 51 and the outer side 54 of the second inclined face 52 may be curved.

In addition, the ridge line 50 may be a curve, a combination of a plurality of straight lines, or a combination of a curve and a straight line.

The embodiments illustrate a case in which the baseline C1 is a straight line passing through the center of the first crossing section T1 in the circumferential direction of the winding drum 2, but the baseline C1 is not limited thereto and may also be a straight line passing through a position shifted from the center of the first crossing section T1.

As described above, there is provided a winch drum capable of winding a rope neatly even in the case where the diameter of the rope is smaller than the ideal dimensions, as well as a crane provided with such a winch drum.

(1) Provided is a winch drum rotatable about a rotation axis in a winding rotation direction in which a rope is wound and an opposite direction. The winch drum includes a winding drum around which the rope is wound such that a plurality of rope portions forming the rope are arranged in a width direction of the winding drum and are also layered in a plurality of layers in a radial direction of the winding drum, and a pair of flanges provided on either end of the winding drum in the width direction. On an outer circumferential surface of the winding drum, a first parallel section having a plurality of parallel grooves parallel to a circumferential direction of the outer circumferential surface and lined up in the width direction, a first crossing section having a plurality of inclined grooves inclined with respect to the circumferential direction and lined up in the width direction, a second parallel section having a plurality of parallel grooves parallel to the circumferential direction and lined up in the width direction, and a second crossing section having a plurality of inclined grooves inclined with respect to the circumferential direction and lined up in the width direction are formed in the above order in the circumferential direction. An inner face of each of the pair of flanges is provided with a rope guide part that guides a rope portion in a higher layer such that the rope portion in the higher layer crosses a rope portion in a lower layer in the first crossing section. The rope guide part has a first inclined face that the rope opposes when the rope is wound, a second inclined face that the rope opposes when the rope is wound, the second inclined face being adjacent to the first inclined face in the opposite direction of the winding rotation direction, and a ridge line positioned at a boundary between the first inclined face and the second inclined face to form an inner side of each. The first inclined face has an outer side at a position shifted in the winding rotation direction with respect to the ridge line, and has a shape that is inclined with respect to the inner face to be positioned farther inward in the width direction of the winding drum as proceeding from the outer side of the first inclined face to the ridge line. The second inclined face has an outer side at a position shifted in the opposite direction of the winding rotation direction with respect to the ridge line, and has a shape that is inclined with respect to the inner face to be positioned farther inward in the width direction of the winding drum as proceeding from the outer side of the second inclined face to the ridge line. The ridge line has an inner edge positioned on the winding drum side and an outer edge positioned closer to an outer circumference of the flange than the inner edge. The ridge line has a shape displaced in the opposite direction of the winding rotation direction with respect to a baseline as proceeding from the inner edge to the outer edge, the baseline being a straight line passing through the rotation axis and the inner edge.

According to the winch drum, the ridge line has a shape displaced in the opposite direction of the winding rotation direction with respect to the baseline as proceeding from the inner edge to the outer edge, the baseline being a straight line passing through the rotation axis and the inner edge. This makes it possible to shift, in the opposite direction of the winding rotation direction, the position where the rope in higher layers opposes the ridge line of the rope guide part in the width direction. With this arrangement, the rope can be neatly wound even in the case where the diameter of the rope decreases compared to the ideal dimension.

(2) It is preferred that in the winch drum the ridge line have a shape inclined in the opposite direction of the winding rotation direction with respect to the baseline.

In this configuration, the distance by which the ridge line of the rope guide part diverges from the baseline in the opposite direction of the winding rotation direction increases as proceeding from the inner edge to the outer edge. Consequently, even in the case where the gap between the rope in the last row and the inner face of the flange cumulatively increases in layers positioned farther radially outward among the plurality of layers, the distance described above can be increased according to the cumulative size of the gap. With this arrangement, even in a layer positioned radially outward where the gap is increased, the rope in the first row crosses over the rope in the last row of the lower layer inwardly in the width direction and is disposed in the proper position, and the rope can be neatly wound.

(3) In the winch drum, it is preferred that the outer side of the second inclined face have an inner edge positioned on the winding drum side and an outer edge positioned closer to an outer circumference of the flange than the inner edge, and the outer side of the second inclined face have a shape that is inclined in the opposite direction of the winding rotation direction with respect to the baseline, such that a distance between the outer edge of the outer side of the second inclined face and the baseline is greater than a distance between the inner edge of the outer side of the second inclined face and the baseline.

In this configuration, the distance by which the outer side of the second inclined face diverges from the baseline in the opposite direction of the winding rotation direction increases as proceeding from the inner edge to the outer edge. Consequently, in this configuration, compared to the case where the outer side is parallel to the baseline, it is possible to provide the second inclined face at a position more distant from the baseline in the opposite direction of the winding rotation direction. In other words, in this configuration, compared to the case where the outer side is parallel to the baseline, it is possible to provide the rope guide part having a thickness in the direction of the rotation axis K even at a position more distant from the baseline in the opposite direction of the winding rotation direction. The range over which the rope guide part having such a thickness can be provided increases as proceeding from the inner edge to the outer edge of the outer side. Imparting such a thickness has advantages like the following. Namely, there is a tendency for the gap between the rope in the last row and the inner face of the flange to cumulatively increase in layers positioned farther radially outward among the plurality of layers formed by the rope wound around the winding drum. This causes a tendency whereby the rope in the first row of a higher layer less easily crosses over the rope in the last row of a lower layer inwardly in the width direction in layers positioned farther radially outward. Even in such a case, in this configuration, a thickness is imparted to the portion corresponding to the second inclined face of the rope guide part even at positions more distant from the baseline in the opposite direction of the winding rotation direction in layers positioned farther radially outward, and the imparted thickness makes it easy for the rope in the first row of the higher layer to cross over the rope in the last row of the lower layer inwardly in the width direction. Also, the thickness imparted in this way also serves a role of suppressing a motion in which the rope in the first row of a higher layer that has crossed over the rope in the last row of a lower layer crosses over the rope in the lower layer in the opposite direction (outwardly in the width direction) and returns to a position near the inner face of the flange.

(4) In the winch drum, it is preferred that the outer side of the second inclined face be positioned on a straight line passing through the rotation axis.

In this configuration, because the outer side of the second inclined face is positioned on a straight line passing through the rotation axis, the angle of the outer edge with respect to the baseline is fixed in all of the plurality of layers. With this arrangement, even in the case where the rope is wound around the winding drum in a plurality of layers, variations in the winding state among the layers occur less easily.

(5) In the winch drum, it is preferred that the outer side of the first inclined face have an inner edge positioned on the winding drum side and an outer edge positioned closer to an outer circumference of the flange than the inner edge, and the outer side of the first inclined face have a shape that is inclined in the winding rotation direction with respect to the baseline, such that a distance between the outer edge of the outer side of the first inclined face and the baseline is greater than a distance between the inner edge of the outer side of the first inclined face and the baseline.

In this configuration, the distance by which the outer side of the first inclined face diverges from the baseline in the winding rotation direction increases as proceeding from the inner edge to the outer edge of the outer side. Consequently, in this configuration, an inclination angle of the first inclined face with respect to the inner face of the flange decreases as proceeding from the inner edge to the outer edge of the outer side compared to the case where the outer side of the first inclined face is parallel to the baseline. The rope used in the crane normally has some degree of rigidity and is not very flexible. Consequently, if the inclination angle can be decreased, the rope in the first row of a higher layer is guided smoothly along the first inclined face. In other words, the first inclined face having a small inclination angle can guide the rope in the higher layer such that the rope in the higher layer crosses over the rope in the last row of a lower layer inwardly in the width direction while bending the rope in the higher layer little by little. Consequently, in this configuration, the rope can be made to cross over smoothly in layers positioned farther radially outward among the plurality of layers. This causes the rope in the first row to cross over the rope in the last row of the lower layer inwardly in the width direction and be more easily disposed in the proper position, even in the case where the gap between the rope in the last row and the inner face of the flange cumulatively increases.

(6) In the winch drum, the outer side of the first inclined face may be positioned on a straight line passing through the rotation axis.

In this configuration, because the outer side of the first inclined face is positioned on a straight line passing through the rotation axis, the angle of the outer edge of the first inclined face with respect to the baseline is fixed in all of the plurality of layers. With this arrangement, even in the case where the rope is wound around the winding drum in a plurality of layers, variations in the winding state among the layers occur less easily. Also, in the case where not only the outer side of the first inclined face is positioned on a straight line passing through the rotation axis, but the outer side of the second inclined face is also positioned on a straight line passing through the rotation axis, the ratio of the first crossing section with respect to the total circumference of the outer circumferential surface of the winding drum, or more specifically, the ratio of the rope guide part with respect to the total circumference of the outer circumferential surface of the winding drum, is fixed in all of the plurality of layers. With this arrangement, in the case where the rope is wound around the winding drum in a plurality of layers, variations in the winding state among the layers occur even less easily.

(7) A crane includes a lower travelling body and an upper slewing body slewably disposed on the lower travelling body, and the winch drum is installed in the upper slewing body.

In the crane, the rope can be neatly wound even in the case where the diameter of the rope decreases compared to the ideal dimension.

The invention claimed is:

1. A winch drum rotatable about a rotation axis in a winding rotation direction in which a rope is wound and an opposite direction of the winding rotation direction, the winch drum comprising:

a winding drum around which the rope is wound such that a plurality of rope portions forming the rope are arranged in a width direction of the winding drum and are also layered in a plurality of layers in a radial direction of the winding drum; and a pair of flanges provided on either end of the winding drum in the width direction, wherein on an outer circumferential surface of the winding drum, a first parallel section having a plurality of parallel grooves parallel to a circumferential direction of the outer circumferential surface and lined up in the width direction, a first crossing section having a plurality of inclined grooves inclined with respect to the circumferential direction and lined up in the width direction, a second parallel section having a plurality of parallel grooves parallel to the circumferential direction and lined up in the width direction, and a second crossing section having a plurality of inclined grooves inclined with respect to the circumferential direction and lined up in the width direction are formed in the above order in the circumferential direction, an inner face of each of the pair of flanges is provided with a rope guide part that guides a rope portion in a higher layer of the plurality of the rope portions such that the rope portion in the higher layer crosses a rope portion in a lower layer of the plurality of the rope portions in the first crossing section, the rope guide part has a first inclined face that the rope opposes when the rope is wound, a second inclined face that the rope opposes when the rope is wound, the second inclined face being adjacent to the first inclined face in the opposite direction of the winding rotation direction, and a ridge line positioned at a boundary between the first inclined face and the second inclined face to form an edge between the first inclined face and the second inclined face, the first inclined face has an outer side at a position shifted in the winding rotation direction with respect to the ridge line, and has a shape that is inclined with respect to the inner face to be positioned farther inward in the width direction of the winding drum as proceeding from the outer side of the first inclined face to the ridge line, the second inclined face has an outer side at a position shifted in the opposite direction of the winding rotation direction with respect to the ridge line, and has a shape that is inclined with respect to the inner face to be positioned farther inward in the width direction of the winding drum as proceeding from the outer side of the second inclined face to the ridge line, the ridge line has an inner edge positioned on the winding drum side and an outer edge positioned closer to an outer circumference of the flange than the inner edge, and the ridge line is angled in the opposite direction of the winding rotation direction with respect to a baseline as proceeding from the inner edge to the outer edge, the baseline being a straight line passing through the rotation axis and the inner edge.

2. The winch drum according to claim 1, wherein the ridge line has a shape inclined in the opposite direction of the winding rotation direction with respect to the baseline.

3. The winch drum according to claim 1, wherein the outer side of the second inclined face has an inner edge positioned on the winding drum side and an outer edge positioned closer to an outer circumference of the flange than the inner edge, and the outer side of the second inclined face has a shape that is inclined in the opposite direction of the winding rotation direction with respect to the baseline, such that a distance between the outer edge of the outer side of the second inclined face and the baseline is greater than a distance between the inner edge of the outer side of the second inclined face and the baseline.

4. The winch drum according to claim 3, wherein the outer side of the second inclined face is positioned on a straight line passing through the rotation axis.

5. The winch drum according to claim 1, wherein the outer side of the first inclined face has an inner edge positioned on the winding drum side and an outer edge positioned closer to an outer circumference of the flange than the inner edge, and the outer side of the first inclined face has a shape that is inclined in the winding rotation direction with respect to the baseline, such that a distance between the outer edge of the outer side of the first inclined face and the baseline is greater than a distance between the inner edge of the outer side of the first inclined face and the baseline.

6. The winch drum according to claim 5, wherein the outer side of the first inclined face is positioned on a straight line passing through the rotation axis.

7. A crane comprising:

a lower travelling body; and an upper slewing body slewably disposed on the lower travelling body, wherein the winch drum according to claim 1 is installed in the upper slewing body.

* * * * *